US009568861B2

(12) United States Patent
Kitabayashi et al.

(10) Patent No.: US 9,568,861 B2
(45) Date of Patent: Feb. 14, 2017

(54) IMAGE FORMING APPARATUS HAVING A CLEANING MEMBER THAT CONTROLS ROTATION SPEED ACCORDING TO SHEET THICKNESS AND NUMBER OF SHEETS

(71) Applicant: KYOCERA Document Solutions Inc., Osaka (JP)

(72) Inventors: Yuta Kitabayashi, Osaka (JP); Koji Uno, Osaka (JP); Satoshi Uemura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/685,910

(22) Filed: Apr. 14, 2015

(65) Prior Publication Data

US 2015/0301494 A1 Oct. 22, 2015

(30) Foreign Application Priority Data

Apr. 17, 2014 (JP) ..... 2014-085462
Apr. 17, 2014 (JP) ..... 2014-085463

(51) Int. Cl.
*G03G 15/16* (2006.01)

(52) U.S. Cl.
CPC .... *G03G 15/161* (2013.01); *G03G 2215/1661* (2013.01)

(58) Field of Classification Search
CPC ..... G03G 21/0035; G03G 15/168
USPC ..... 399/43, 71
See application file for complete search history.

(56) References Cited

U.S. PATENT DOCUMENTS 5,229,817 A * 7/1993 Lange ..... G03G 21/0035 399/34
5,546,177 A * 8/1996 Thayer ..... G03G 21/0035 399/353
2008/0159765 A1* 7/2008 Shigezaki ..... G03G 21/0035 399/71
2009/0297186 A1* 12/2009 Fromm ..... G03G 15/2025 399/45

(Continued)

FOREIGN PATENT DOCUMENTS

JP H10-026918 A 1/1998
JP 11212417 A * 8/1999

OTHER PUBLICATIONS

Kanda. English Translation of JP11212417. Published Aug. 1999. Translated Sep. 2015.*

*Primary Examiner* — Walter L Lindsay, Jr.
*Assistant Examiner* — Philip Marcus T Fadul
(74) *Attorney, Agent, or Firm* — Studebaker & Brackett PC

(57) ABSTRACT

An image forming apparatus includes an image carrier, a cleaning member, a rotation controlling part, a first obtaining part and a mode changing part. The image carrier has a surface to carry a toner image transferred onto a sheet. The cleaning member contacts the surface of the image carrier at a downstream side in a rotating direction of the image carrier from a transferring position transferring the toner image to collect a toner from the image carrier and to hold the toner. The rotation controlling part has a first speed control mode rotating the cleaning member at a first rotational speed and a second speed control mode rotating the cleaning member at a second rotational speed faster than the first rotational speed and switches from the first speed control mode to the second speed control mode at predetermined switch timing.

7 Claims, 10 Drawing Sheets

(56) References Cited

U.S. PATENT DOCUMENTS

| | | | | |
|---|---|---|---|---|
| 2010/0014883 | A1* | 1/2010 | Thayer | G03G 21/0035 399/71 |
| 2010/0157305 | A1* | 6/2010 | Henderson | G03G 15/5062 356/445 |
| 2010/0196039 | A1* | 8/2010 | Ono | G03G 15/2039 399/69 |

* cited by examiner

FIG. 7

| | | PRINTS | | | | | | |
|---|---|---|---|---|---|---|---|---|
| CLEANING TIME | COVERAGE RATE | 0k | 100k | 200k | 300k | 400k | 500k | 600k |
| CONSTANT | 5% | ○ | ○ | ○ | ○ | ○ | ○ | ○ |
| | 20% | ○ | ○ | △ | × | × | × | × |
| INCREASE ACCORDING TO WEAR AMOUNT | 5% | ○ | ○ | ○ | ○ | ○ | ○ | ○ |
| | 20% | ○ | ○ | ○ | ○ | ○ | ○ | △ |

k equals to 1000 sheets

○ : 1 or less of 3000 sheets

△ : 1 of 100-3000 sheets

× : 1 or more of 100 sheets

IMAGE FORMING APPARATUS HAVING A CLEANING MEMBER THAT CONTROLS ROTATION SPEED ACCORDING TO SHEET THICKNESS AND NUMBER OF SHEETS

INCORPORATION BY REFERENCE

This application is based on and claims the benefit of priority from Japanese Patent application No. 2014-085463 filed on Apr. 17, 2014, and Japanese Patent application No. 2014-085462 filed on Apr. 17, 2014, the entire contents of which are incorporated herein by reference.

BACKGROUND

The present disclosure relates to an image forming apparatus including a cleaning device cleaning a toner remained on an intermediate transferring belt used for intermediate transfer of a toner image.

An image forming apparatus, such as a copying machine or a printer, forming an image onto a sheet by electrographic manner carries out development by using a toner. To an electrostatic latent image formed on an image carrier, such as a photosensitive drum, the toner is supplied from a developing device and a toner image is developed. The toner image is transferred onto a sheet as a recording medium. The sheet having the toner image transferred is heated and pressured by a fixing device. Thereby, the toner image is fixed onto the sheet and the image is formed on the sheet. Thus, a series of image forming operation is completed.

As a manner transferring the toner image onto the sheet, there are a dynamic transferring manner and an intermediate transferring manner. The dynamic transferring manner is a manner transferring dynamically the toner image, which is formed onto the photosensitive drum as a transferring body, onto the sheet. On the other hand, the intermediate transferring manner is a manner transferring (first-transferring) once the toner image, which is formed onto the photosensitive drum, onto the intermediate transferring belt and then transferring (second-transferring) the toner image onto the sheet. In any transferring manner, if the toner scattering to the transferring body and non-transferred toner are remained, quality of the formed image is degraded. Therefore, the image forming apparatus includes a cleaning device removing the remained toner from the transferring body.

The cleaning device included in the intermediate transferring type image forming apparatus rotates a fur brush roller having bias applied, thereby removing the toner remained on the intermediate transferring belt by physical scraping force and electrostatic force of the fur brush roller. The removed toner is moved to an electrically charged collecting roller coming into contact with the fur brash roller and being rotated. The moved toner is stripped by a blade coming into contact with the collecting roller and collected into a waste toner box.

In such a cleaning device, in a case where a quantity of the toner adhered on the fur brush roller is large or a case where a charged amount of the toner is small, the toner is accumulated on the fur brush roller. If the toner accumulated on the fur brush roller is increased, a phenomenon where an unnecessary toner is moved from the fur brush roller to the intermediate transferring belt in reverse is caused. By adhering of the unnecessary toner onto the intermediate transferring belt, the toner image transferred onto the sheet is soiled by the unnecessary toner. If the soiled toner image is fixed onto the sheet, a problem that quality of the formed image is degraded is caused.

As a conventional technique for this problem, there is a way removing the remained toner from the intermediate transferring belt by heightening rotational speed of the fur brush roller in a case where the toner image with high concentration is formed onto the intermediate transferring belt.

In a case where the sheet which the toner image is transferred is thick, in order to heat the sheet to temperature where the fixing device can fix the toner image, the fixing device conveys the sheet at speed slower than usual. In this case, traveling speed of the intermediate transferring belt at an upstream side of the fixing belt is lowered, too. When a difference between relative speeds of the intermediate transferring belt and fur brash roller becomes large, the intermediate transferring belt is damaged by the fur brash roller. In order to prevent the intermediate transferring belt from being damaged, the rotational speed of the fur brush roller is lowered, too. If the rotational speed of the fur roller brush is lowered, centrifugal force of the fur brush roller is weakened, movement of the toner to the collecting roller is stagnated and collecting capacity is deteriorated. As a result, a quantity of the toner accumulated in the fur brush roller is increased.

In a case where transferring of the toner image onto the thick sheet is carried out successively or a case where the number of transferring the toner image onto the thick sheet is larger than the number of transferring the toner image onto the sheet with usual thickness, if the transferring onto the sheet with usual thickness is carried out after the transferring onto the thick sheet, the following problem is caused. That is, when the toner image is transferred onto the sheet with usual thickness, the speed of each component, such as the intermediate transferring belt, is returned to original speed. In such a case, when the fur brush roller is rotated at usual speed, the centrifugal force becomes stronger than that at low speed. The toner accumulated excessively in the fur brush roller may be discharged to the intermediate transferring belt before the toner is collected by the collecting roller. The toner image is transferred onto the intermediate transferring belt soiled by the discharged toner. In such a case, a problem that the quality of the image formed onto the sheet is degraded is caused.

Moreover, in a conventional technique, the rotational speed of the fur brush roller during cleaning is determined regardless of a frictional wear state of the fur brush roller rubbed to the intermediate transferring belt and collecting roller. Therefore, new problems that frictional wear of the fur brush roller is progressed and the toner is moved from the fur brush roller to the intermediate transferring belt in reverse are caused.

SUMMARY

In accordance with an embodiment of the present disclosure, an image forming apparatus includes an image carrier, a cleaning member, a rotation controlling part, a first obtaining part and a mode changing part. The image carrier is arranged rotatably and has a surface to carry a toner image transferred onto a sheet. The cleaning member rotates with coming into contact with the surface of the image carrier at a downstream side in a rotating direction of the image carrier from a transferring position transferring the toner image to collect a toner from the image carrier and to hold the toner. The rotation controlling part has a first speed control mode rotating the cleaning member at a first rotational speed according to a thickness of the sheet when the toner image is transferred onto the sheet and a second speed control mode rotating the cleaning member at a second rotational speed faster than the first rotational speed and switches from the first speed control mode to the second speed control mode at predetermined switch timing. The first obtaining part obtains a first transferring number indicating the number of sheets having a thickness equal to or more than a first threshold determined in advance among sheets to be subjected to transferring of the toner image. The mode changing part changes the switching timing in accordance with the first transfer number.

In accordance with another embodiment of the present disclosure, an image forming apparatus includes an image carrier, a cleaning member, a deciding part and a rotation controlling part. The image carrier is arranged rotatably and has a surface to carry a toner image transferred onto a transferred medium. The cleaning member rotates with coming into contact with the surface of the image carrier at a downstream side in a rotating direction from a transferring position transferring the toner image onto the transferred medium to collect a toner from the image carrier and to hold the toner. The deciding part decides a wear amount of the cleaning member due to contact. The rotation controlling part changes rotational speed of the cleaning member in accordance with the wear amount decided by the deciding part.

The above and other objects, features, and advantages of the present disclosure will become more apparent from the following description when taken in conjunction with the accompanying drawings in which a preferred embodiment of the present disclosure is shown by way of illustrative example.

BRIEF DESCRIPTION OF THE DRAWINGS

FIG. 7 is a table showing the number of prints with toner soiling varied according to cleaning time.

DETAILED DESCRIPTION

In the following, a first embodiment of the present disclosure will be described with reference to the accompanying drawings. Incidentally, following each embodiment is an example of actualization of the disclosure and does not restrict technical scope of the disclosure.

Figure 1:
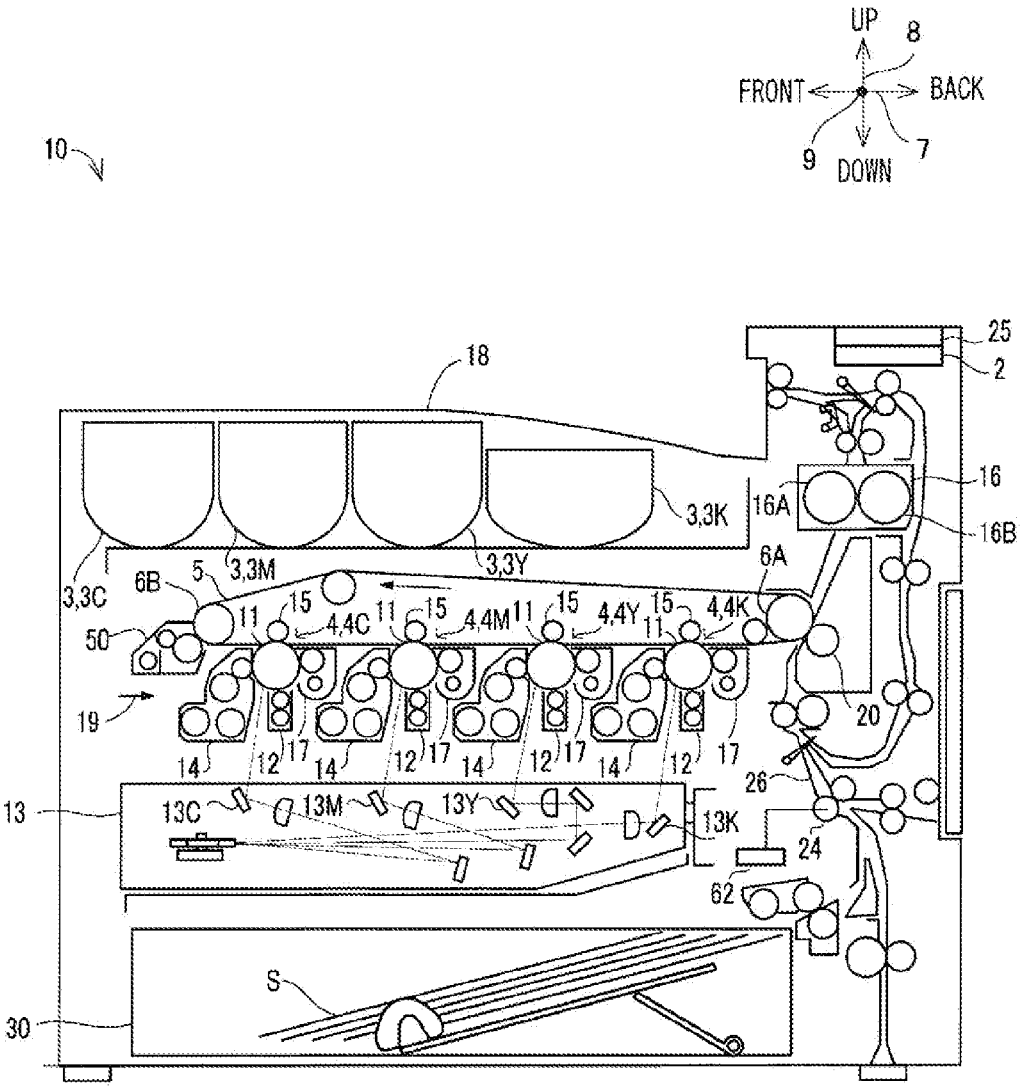
FIG. 1 is a sectional view schematically showing structure of an image forming apparatus according to an embodiment of the present disclosure.

Schematic structure of an image forming apparatus according to the first embodiment of the present disclosure (an example of the image forming apparatus of the present disclosure) as shown in FIG. 1 will be described. For convenience of explanation, a vertical direction in an installation state in which the image forming apparatus 10 is availably installed (a state shown in FIG. 1) is defined as upward and downward directions 8. In addition, forward and backward directions 7 are defined so that the forward direction directs to a side of a front face (to a left side) shown in FIG. 1 in the installation state. Moreover, left and right directions 9 are defined on the basis of the front face of the image forming apparatus 10 in the installation state.

As shown in FIG. 1, the image forming apparatus 10 is a color printer including a controlling part 2, a plurality of image forming units 4, an intermediate transferring belt 5 (an example of an image carrier of the present disclosure as well as an intermediate transferring belt), an optical scanning device 13, a second transferring roller 20, a fixing device 16 (an example of a fixing part of the present disclosure), a sheet tray 18, a sheet feeding cartridge 30, an operating/displaying part 25, a conveying path 26, a torque sensor 62, a belt cleaning device 50 and others. The image forming apparatus 10 forms a monochrome image or a color image on a sheet S (an example of a sheet of the present disclosure as well as an example of a transferred medium) on the basis of inputted image data. The sheet S is an example of the sheet of the present disclosure as well as a sheet material, such as a paper, a coated paper, a postcard, an envelope and an OHP (overhead projector) sheet. As other examples of the image forming apparatus according to the present disclosure, there are a facsimile, a copying machine, a multifunction peripheral and others. Incidentally, the operating/displaying part 25 is a touch panel or the like displaying various information in accordance with control indication from the controlling part 2 and inputting various information to the controlling part 2 in accordance with user operation. The user inputs the number of the sheets S, onto which the image is formed, a size of the sheets S and others from the operating/displaying part 25 to the controlling part 2.

The fixing device 16 fixes the toner image onto the sheet S having transferred toner image. The fixing device 16 has a heating roller 16A heated at high temperature and a pressuring roller 16B arranged to face to the heating roller 16A. The sheet S conveyed to the fixing device 16 is conveyed with being interposed between the heating roller 16A and pressuring roller 16B. A heating time during the heating roller 16A heats the toner image is lengthened in proportion to a thickness of the sheet S. Therefore, in order to the sheet S during the heating time according to the thickness, conveying speed by the heating roller 16A and pressuring roller 16B is determined according to the thickness of the sheet S in advance.

Each image forming unit 4 (4C, 4M, 4Y, 4K) is an electrographic type image forming unit including a photosensitive drum 11 (an example of a photosensitive drum of the present disclosure), a charging device 12 (an example of a second voltage applying part of the present disclosure), a developing device 14 (an example of a developing part of the present disclosure), a first transferring roller 15, a cleaning device 17 (an example of a collecting part of the present disclosure) and others. The image forming units 4 are arranged in parallel along a traveling (rotating) direction (a horizontal direction) of the intermediate transferring belt 5 to configure so-called tandem type image forming unit. Concretely, the image forming unit 4C forms a toner image corresponding to cyan (C), the image forming unit 4M forms a toner image corresponding to magenta (M), the image forming unit 4Y forms a toner image corresponding to yellow (Y), and the image forming unit 4K forms a toner image corresponding to black (K). In order from an upstream side in the traveling (rotating) direction (a direction indicated by an arrow 19) of the intermediate transferring belt 5, the image forming unit 4C for cyan, the image forming unit 4M for magenta, the image forming unit 4Y for yellow and the image forming unit 4K for black are arranged in a line.

The developing device 14 includes a toner storing chamber, agitating member, a developing roller, a magnetic roller and others. The toner storing chamber stores a toner supplied from a toner container 3. The agitating member is a helical formed member arranged in the toner storing chamber. The agitating member is rotated to agitate the toner and a carrier in the toner storing chamber. The toner is electrically charged by agitation of the agitating member. The magnetic roller supplies the charged toner to the developing roller. The developing roller supplies the toner to the charged photosensitive drum 11 in development to develop an electrostatic latent image on the photosensitive drum 11 by the toner. Thereby, the toner image is formed on the photosensitive drum 11.

The intermediate transferring belt 5 is an intermediate transferring member carrying the toner image of each color first-transferred (intermediate-transferred) from the photosensitive drum 11 of each image forming unit and conveying the toner image to a second transfer position in which second transfer is carried out onto the sheet S. The intermediate transferring belt 5 is composed of a belt formed member extended by a driving roller 6A and a following roller 6B and is supported travelably (rotatably). The intermediate transferring belt 5 is traveled so that the toner images of the respective colors are aligned and carried at the same position on its outer circumference face. The intermediate transferring belt 5 is traveled (rotated), by being supported by the driving roller 6A and following roller 6B, so that its surface comes into contact with a surface of the photosensitive drum 11. In the intermediate transferring belt 5, when its surface is passed between each photosensitive drum 11 and each first transferring roller 15, the toner images from the photosensitive drums 11 are superimposed and transferred in sequence. The optical scanning device 13 includes a laser light source emitting a laser light of each color, a polygon mirror scanning the laser light, mirrors 13C, 13M, 13Y, 13K reflecting the scanned laser light and others. The optical scanning device 13 irradiates the photosensitive drum 11 of each image forming unit 4 with the laser light on the basis of the inputted image data of each color to form the electrostatic latent image onto each photosensitive drum 11.

In the image forming apparatus 10 thus configured, the color image is formed onto the sheet S fed from the sheet feeding cartridge 30 along the conveying path 26 by the following procedures and the sheet S after image forming is ejected to the sheet tray 18. In the conveying path 26, various conveying rollers including an intermediate conveying roller 24 are arranged so as to convey the sheet S loaded in the sheet feeding cartridge 30 to the sheet tray 18 via the second transferring roller 20 and fixing device 16. Driving torques of the various conveying rollers including the intermediate conveying roller 24 are varied according to presence/absence of the sheet S and the thickness of the sheet S.

In each image forming unit 4, the toner image is transferred onto the intermediate transferring belt 5 by the following procedures. Concretely, the photosensitive drum 11 is rotated at constant speed by a driving motor 11A (refer to FIG. 5). First, by the charging device 12, the photosensitive drum 11 formed in a cylindrical shape is electrically charged at a predetermined potential evenly. Next, by the optical scanning device 13, the surface of the photosensitive drum 11 is irradiated with a light based on the image data of corresponding color. Thereby, the electrostatic latent image is formed onto the surface of the photosensitive drum 11. The electrostatic latent image on the photosensitive drum 11 is developed (visualized) as the toner image of each color by the charged toner supplied from the developing device 14. Subsequently, the toner image of each color formed on the photosensitive drum 11 is transferred onto the intermediate transferring belt 5 by the first transferring roller 15. On the intermediate transferring belt 5, the cyan toner image, the magenta toner image, the yellow toner image and the black toner image are aligned and transferred at the same position in sequence. Thereby, the color image based on the image data is formed onto the intermediate transferring belt 5. The photosensitive drum is electrically discharged by a discharging device after the toner image of each color is transferred onto the intermediate transferring belt 5. The toner adhered on the surface of the photosensitive drum 11 after transferring is collected by the cleaning device 17. Incidentally, to each developing device 14, the toner (a developer) is replenished from the attachable/detachable toner container 3 (3C, 3M, 3Y, 3K) corresponding to each color.

Next, the color image on the intermediate transferring belt 5 is transferred by the second transferring roller 20 onto the sheet S conveyed from the sheet feeding cartridge 30 via the conveying path 26. The sheet S having the transferred color image is conveyed to the fixing device 16 by conveying parts (not shown). The fixing device 16 interposes the sheet S by the heating roller 16A and pressuring roller 16B and conveys the sheet S at the conveying speed according to the thickness of the sheet S, thereby fixing (melting and adhering) the color image onto the sheet S. After that, the sheet S is ejected to the sheet tray 18.

Moreover, in the image forming apparatus 10, a contacting/separating mechanism (not shown) contacting/separating the photosensitive drums 11 and first transferring rollers 15 of the image forming units 4C, 4M, 4Y with/from the intermediate transferring belt 5 is arranged. In a case where the monochrome image is printed in the image forming apparatus 10, the photosensitive drums 11 and first transferring rollers 15 of the image forming units 4C, 4M, 4Y are separated from the intermediate transferring belt 5 by the contacting/separating mechanism. Thereby, only the black toner image is transferred from the image forming unit 4K to the intermediate transfer belt 5 and the monochrome image is transferred from the intermediate transfer belt 5 to the sheet S.

Thus, the image forming apparatus 10 has the plurality of the image forming units 4 (4C, 4M, 4Y, 4K) superimposed and transferred the toner images of the respective colors onto the intermediate transferring belt 5 during traveling, thereby forming the color image onto the surface of the intermediate transferring belt 5. Further, the image forming apparatus 10 has the second transferring roller 20 transferred the formed color image from the intermediate transferring belt 5 to the sheet S, thereby forming the color image onto the sheet S. Incidentally, as other examples, a configuration that the color image is superimposed and transferred directly onto the sheet S conveyed on a conveying belt or a configuration a roller formed intermediate transferring member is used instead of the intermediate transferring belt 5 may be considered.

The torque sensor 62 is connected with a driving shaft (not shown) of the intermediate conveying roller 24. The torque sensor 62 detects torque variation of the intermediate conveying roller 24 at timing when the sheet S conveyed in the conveying path 26 is inserted into a nip part of the intermediate conveying roller 24. The torque sensor 62 outputs a torque value signal according to the torque variation to the controlling part 2. The driving torques of the various conveying rollers including the intermediate conveying roller 24 are varied according to the presence/absence of the sheet S and the thickness of the sheet S. The controlling part 2 decides the thickness of the sheet S in accordance with the torque value signal inputted from the torque sensor 62. Incidentally, process of deciding the thickness of the sheet S by the controlling part 2 and torque sensor 62 will be described in detail later.

Figure 2:
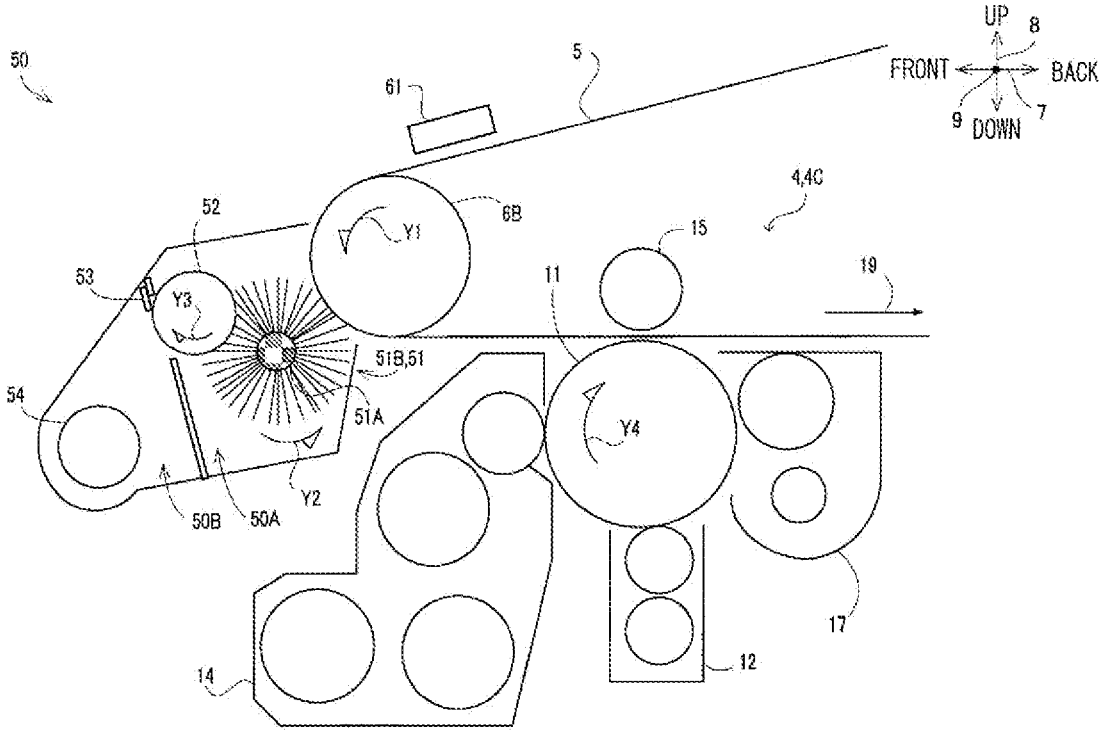
FIG. 2 is a sectional view schematically showing structure of a belt cleaning device and its peripheral devices.
Figure 5:
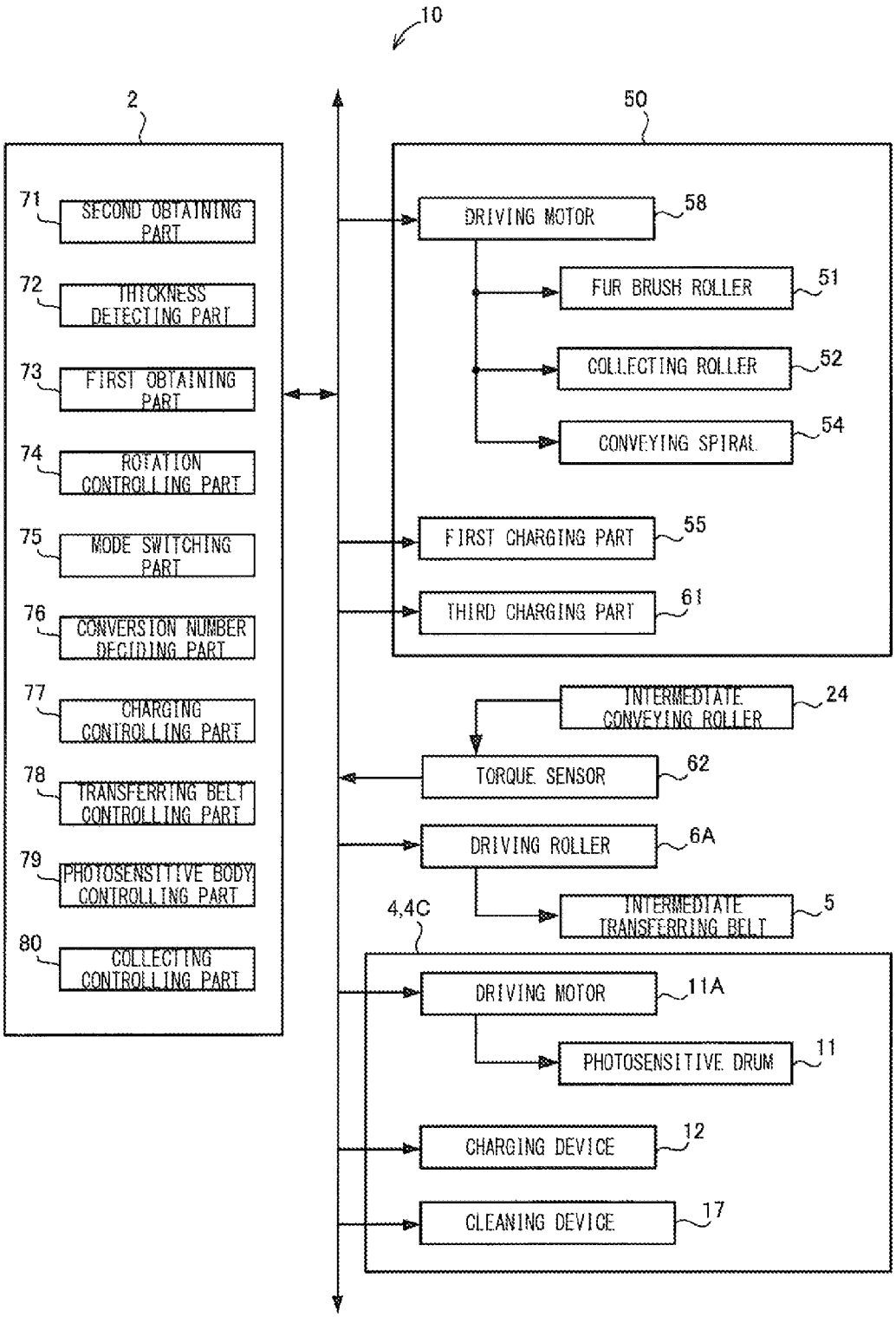
FIG. 5 is a block diagram schematically showing structure of a controlling part of the image forming apparatus.

The belt cleaning device 50 collects the toner remained on the intermediate transferring belt 5 at a downstream side in the traveling (rotating) direction of the intermediate transferring belt 5 from a transfer position of the second transferring roller 20 in which the toner image is transferred from the intermediate transferring belt 5 onto the sheet S. As shown in FIG. 1, the belt cleaning device 50 is arranged at the upstream side in the traveling (rotating) direction (the direction indicated by the arrow 19) of the intermediate transferring belt 5 from the image forming unit 4C for cyan. Onto the intermediate transferring belt 5 after the toner is collected by the belt cleaning device 50, the toner images of the respective colors are first-transferred by the respective image forming units 4 in sequence. As shown in FIGS. 2 and 5, the belt cleaning device 50 includes a fur brush roller 51 (an example of a cleaning member of the present disclosure), a collecting roller 52 (an example of a collecting member of the present disclosure), a cleaning blade 53 (an example of a scraping member of the present disclosure), a conveying spiral 54, a first charging part 55 (an example of a first voltage applying part of the present disclosure), a driving motor 58 and a third charging part 61 (an example of a third voltage applying part of the present disclosure).

The fur brush roller 51 has a plurality of brush bristles 51B projected from an outer circumference of a rotating shaft 51A to an outward side in a radial direction. The rotating shaft 51A is a metal shaft. The brush bristles 51B are made of acrylic resin or nylon resin having electrical conductivity. Around a circumference face of the rotating shaft 51A, a foundation cloth made of synthetic resin is wound, and the brush bristles 51B are implanted to the foundation cloth evenly. The rotating shaft 51A and brush bristles 51B are rotated in a body. The rotating shaft 51A is arranged in a roughly orthogonal direction to the traveling (rotating) direction of the intermediate transferring belt 5 and rotated by the driving motor 58. The rotating shaft 51A is rotated so that a rotating direction of the brush bristles 51B at a position coming into contact with the intermediate transferring belt 5 becomes an opposite direction (a direction indicated by an arrow Y2) to the traveling (rotating) direction (a direction indicated by an arrow Y1) of the intermediate transferring belt 5. A distance between the rotating shaft 51A and intermediate transferring belt 5 is shorter than a length of each brush bristle 51B. The brush bristles 51B of the fur brush roller 51 is arranged at a position coming into contact with the surface of the intermediate transferring belt 5 to rotate with contacting. Therefore, the brush bristles 51B are deformed by contact with the intermediate transferring belt 5. Thereby, the toner remained on the intermediate transferring belt 5 is collected by the fur brush roller 51 and held inside the brush bristles 51B of the fur brush roller 51.

The collecting roller 52 is a roller rotating with coming into contact with the fur brush roller 51 to collect the toner held by the fur brush roller 51. The collecting roller 52 is a cylindrical member made of stainless steel or aluminum to have the same axial direction as the rotating shaft 51A of the fur brush roller 51 and to rotate in an opposite direction (a direction indicated by an arrow Y3) to the fur brush roller 51.

The cleaning blade 53 scrapes the toner adhered on a surface of the collecting roller 52 by coming into contact with the surface of the collecting roller 52. The cleaning blade 53 is made of urethane and fixed to a housing of the belt cleaning device 50 so that one end part comes into contact with the collecting roller 52. When the collecting roller 52 is rotated, the toner adhered on the collecting roller 52 is scraped by the cleaning blade 53. The belt cleaning device 50 includes a second chamber 50B in addition to a first chamber 50A in which the fur brush roller 51 is arranged. The toner scraped from the collecting roller 52 by the cleaning blade 53 falls into the second chamber 50B arranged below the cleaning blade 53. Thereby, the toner collected by the collecting roller 52 is stored by the second chamber 50B.

The conveying spiral 54 is a member conveying the toner scraped by the cleaning blade 53 and accumulated in the second chamber 50B toward a toner collecting bottle (not shown). The conveying spiral 54 is formed in a spiral shape and arranged in the second chamber 50B to have a rotating shaft along the left and right directions 9. When the conveying spiral 54 is rotated, the toner accumulated in the second chamber 50B is conveyed to the toner collecting bottle.

The first charging part 55 applies a first bias to the fur brush roller 51 via the collecting roller 52 in order to collect the toner on the intermediate belt 5 by the fur brush roller 51. The first bias is a voltage with a reverse polarity to a first charging polarity of the toner remained on the intermediate transferring belt 5. The collecting roller 52, the brush bristles 51B of the fur brush roller 51, the intermediate transferring belt 5 and the following roller 6B have a property of electrical conductivity. The following roller 6B is grounded. Therefore, by application of the first charging part 55, voltage according to the first bias is applied among the collecting roller 52, the brush bristles 51B of the fur brush roller 51, the intermediate transferring belt 5 and the following roller 6B. The toner remained on the intermediate belt 5 is collected by the fur brush roller by physical force and electrical force produced by coming into contact with the brush bristles 51B of the fur brush roller 51.

The third charging part 61 is arranged at the upstream side in the traveling (rotating) direction of the intermediate transferring belt 5 from the fur brush roller 51. When the controlling part 2 controls so as to collect the toner on the intermediate transferring belt 5, the third charging part 61 applies a third bias with a reverse polarity to the first bias applied by the first charging part 55 to the intermediate transferring belt 5 to electrically charge the toner on the intermediate transferring belt 5 to the first charging polarity. Thereby, a charging polarity of the remained toner is matched with the same polarity as the first charging polarity and the remained toner becomes easy to be collected by the fur brush roller 51 with the reverse polarity.

Figure 3A:
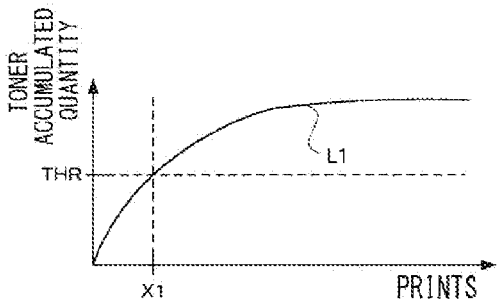
FIGS. 3A-3D are graphs plotting toner accumulated quantity in a fur brush roller.
Figure 3B:
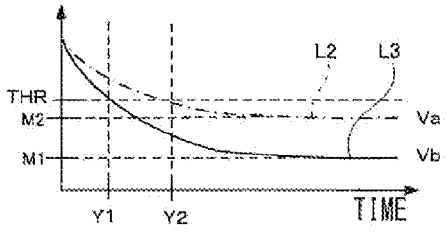
Figure 3C:
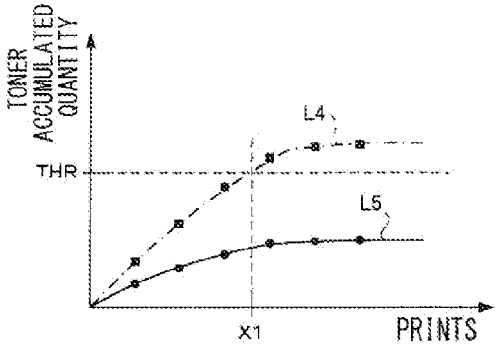
Figure 3D:
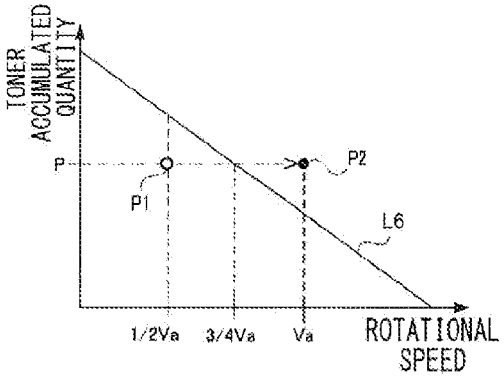

Next, a property of a toner accumulated quantity in the fur brush roller 51 will be described. FIG. 3A is a graph showing relationship between the number of prints and the toner accumulated quantity in the fur brush roller 51. FIG. 3B is a graph showing relationship between a rotational speed of the fur brush roller 51 and the toner accumulated quantity. FIG. 3C is a graph showing a difference of the toner accumulated quantities after cleaning in accordance with a difference of the rotational speeds of the fur brush roller 51 during cleaning. FIG. 3D is a graph showing relationship between a rotational speed of the fur brush roller 51 during image forming and the toner accumulated quantity held by the fur brush roller 51. Incidentally, values Va and Vb in FIG. 3B indicate the rotational speeds of the fur brush roller 51. When a first speed control mode or a second speed control mode is executed as a speed control mode by the controlling part 2 as described later, the rotational speed of the fur brush roller 51 is switched. The rotational speed Vb (an example of a second rotational speed of the present disclosure) of the fur brush roller 51 in the second speed control mode is a speed faster than the rotational speed Va (an example of a first rotational speed of the present disclosure) of the fur brush roller in the first speed control mode. The first speed control mode is a mode executed by the controlling part 2 when the fur brush roller 51 is rotated at the rotational speed Va during image forming transferring the toner image on the intermediate transferring belt 5 onto the sheet S. The second speed control mode is a mode executed by the controlling part 2 when the fur brush roller 51 is rotated at the rotational speed Vb at predetermined timing except for a time of image forming.

If the number of prints, in which the image is formed onto the sheet S by the image forming apparatus 10, is increased, a toner quantity remained on the intermediate transferring belt 5 is also increased. As indicated by a solid line L1 in FIG. 3A, while the number of prints is small, a toner quantity collected and held by the fur brush roller 51 is relatively large. That is, the fur brush roller 51 has a sufficient margin capacity newly holding the toner. However, the margin capacity of the fur brush roller 51 is restricted. Therefore, the number of prints is gradually increased, as indicated by the solid line L1, the actual toner quantity held by the fur brush roller 51 (hereinafter, called as a toner accumulated quantity) is increased in proportion to the number of prints. Further, if the number of prints is increased, the toner accumulated quantity is converged to a predetermined convergence amount. If the toner accumulated quantity reaches the predetermined convergence amount, the margin capacity is used up. Therefore, the toner remained on the intermediate transferring belt 5 cannot be collected by the fur brush roller 51. There is a threshold quantity THR when the fur brush roller 51 cannot collect sufficiently the toner from the intermediate transferring belt 5 while the toner accumulated quantity of the fur brush roller 51 reaches the predetermined convergence amount. The threshold quantity THR corresponds to the number X1 of prints. Concretely, a phenomenon where the toner non-collected by the fur brush roller 51 is remained on the intermediate transferring belt 5 and where the toner held by the fur brush roller 51 is moved to the intermediate transferring belt 5 in reverse is caused. The cause of such phenomenon is degradation of toner collecting capacity of the fur brush roller 51 due to the toner accumulated quantity of the fur brush roller 51 reached the predetermined convergence amount. If the toner cannot be collected by the fur brush roller 51 and new toner image is transferred onto the intermediate transferring belt 5 with the remained toner, the toner image to be transferred and the remained toner are transferred onto the sheet S. If, in such a state, the toner image is fixed onto the sheet S by the fixing device 16, a problem that quality of the formed image is degraded is caused.

In order to solve such a problem, the toner collected and held by the fur brush roller 51 is removed by the collecting roller 52. The collecting roller 52 is electrically charged at a reverse polarity to the toner held by the fur brush roller 51 and is rotated with coming into contact with the fur brush roller 51 to remove the toner from the fur brush roller 51. However, the toner held near the rotating shaft 51A at the center of the fur brush roller 51 and the toner with a deteriorated electrical charging property may not be collected by the collecting roller 52 to remain in the fur brush roller 51. As shown in FIG. 3B, the toner accumulated quantity of the fur brush roller 51 is varied according to the rotational speed. If the rotational speed of the fur brush roller 51 is heightened, the toner accumulated quantity is decreased because the held toner is discharged by centrifugal force. If the toner accumulated quantity is decreased, because the margin capacity is increased, the toner collecting capacity of the fur brush roller 51 is improved. Therefore, since a time heightening the rotational speed of the fur brush roller 51 is prepared in a time of cleaning except for the time of image forming, the toner accumulated quantity is decreased and the toner collecting capacity of the fur brush roller 51 is improved. As shown in FIG. 3B, as rotating time of the fur brush roller 51 is increased, the toner accumulated quantity of the fur brush roller 51 is lowered to convergence amount less than the threshold quantity THR. Moreover, as the rotational speed of the fur brush roller 51 is the higher, the toner accumulated quantity of the fur brush roller 51 becomes less than the threshold quantity THR in shorter time.

As shown in FIG. 3B, the rotational speed Vb in the time of cleaning is a speed faster than the rotational speed Va in image forming. It is assumed that, in the fur brush roller 51 before rotating, the toner accumulated quantity more than the threshold quantity THR is held and the margin capacity is small. The toner accumulated quantity indicated by a dashed line L2 corresponds to a quantity in a case where the fur brush roller 51 is rotated at the rotational speed Va. The toner accumulated quantity indicated by a solid line L3 corresponds to a quantity in a case where the fur brush roller 51 is rotated at the rotational speed Vb. Rotating time when the toner accumulated quantity of the fur brush roller 51 rotated at the rotational speed Vb as indicated by the solid line L3 becomes less than the threshold quantity THR is time Y1. Rotating time when the toner accumulated quantity of the fur brush roller 51 rotated at the rotational speed Va as indicated by the dashed line L2 becomes less than the threshold quantity THR is time Y2. The time Y1 is shorter than the time Y2. Thus, since the rotational speed Vb in the time of cleaning is set to the speed faster than the rotational speed Va in image forming, it is possible to shorten the time until the toner accumulated quantity of the fur brush roller 51 becomes less than the threshold quantity THR. Moreover, the higher the rotational speed of the fur brush roller 51, the toner accumulated quantity becomes smaller. Convergence amount when the toner accumulated quantity of the fur brush roller 51 rotated at the rotational speed Vb as indicated by the solid line L3 is converged is convergence amount M1. Convergence amount when the toner accumulated quantity of the fur brush roller 51 rotated at the rotational speed Va as indicated by the dashed line L2 is converged is convergence amount M2. The convergence amount M1 is smaller than the convergence amount M2. Thus, since the rotational speed Vb in the time of cleaning is set to the speed faster than the rotational speed Va in image forming, it is possible to decrease the toner accumulated quantity of the fur brush roller 51 to the small convergence amount and to improve the toner collecting capacity.

In FIG. 3C, the toner accumulated quantity indicated by a dashed line L4 joining black square points indicates a quantity in a case where the fur brush roller 51 is rotated at the rotational speed Va (550 m/s) in the second speed control mode. The toner accumulated quantity indicated by a solid line L5 joining black round points indicates a quantity in a case where the fur brush roller 51 is rotated at the rotational speed Vb (660 m/s) in the second speed control mode. As indicated by the dashed line L4, when the number of prints is X1 (approximately 200,000 prints) or less, the toner accumulated quantity of the fur brush roller 51 can be kept less than the threshold quantity THR. As indicated by the solid line L5, the toner accumulated quantity of the fur brush roller 51 can be kept less than the threshold quantity THR. Thus, since the controlling part 2 change the rotational speed of the fur brush roller 51 in the second speed control mode, it is possible to decrease the toner accumulated quantity held by the fur brush roller 51. Moreover, if the rotating time of the fur brush roller 51 is increased, the toner accumulated quantity collected from the intermediate transferring belt 5 and held by the fur brush roller 51 is decreased. Thereby, it is possible to improve the toner collecting capacity collecting the toner from the intermediate transferring belt 5 by the fur brush roller 51.

Figure 4A:
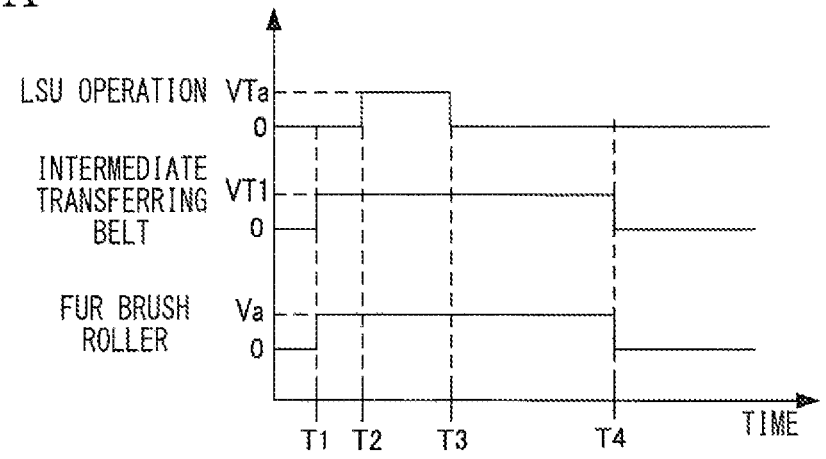
FIGS. 4A-4C are timing charts of driving operation of an intermediate transferring belt and the fur brush roller.
Figure 4B:
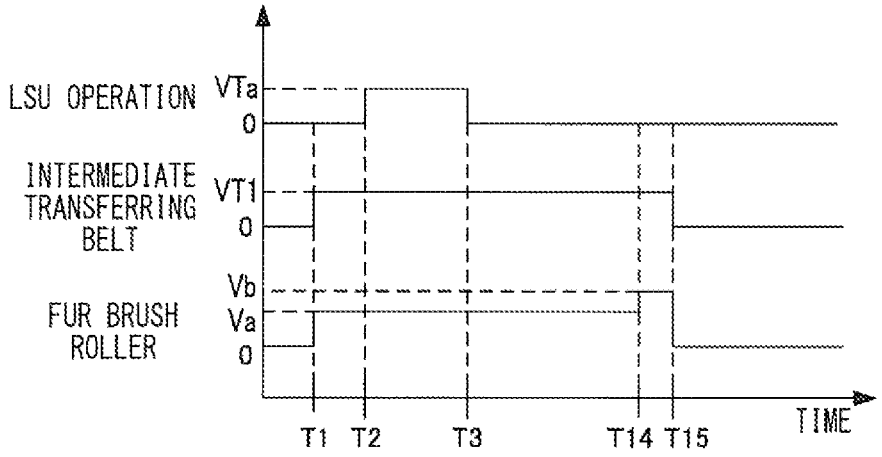

Next, the operation when rotating the in the second speed control mode will be described. FIG. 4A is a timing chart in a case where the fur brush roller 51 is rotated at the rotational speed Va (550 m/s) in the second speed control mode. FIG. 4B is a timing chart in a case where the fur brush roller 51 is rotated at the rotational speed Vb (660 m/s) in the second speed control mode. The timing chart of FIG. 4A corresponds to the case of the dashed line L4 in FIG. 3C and the timing chart of FIG. 4B corresponds to the case of the solid line L5 in FIG. 3C. A common point between the timing charts of FIGS. 4A and 4B is to form the image onto the sheet S with the usual thickness in the first speed control mode and to clean the fur brush roller 51 in the second speed control mode.

At timing T1, when image forming indication is inputted from the operating/displaying part 25, the controlling part 2 controls so that the intermediate transferring belt 5 is traveled at traveling speed VT1 (458 mm/s) and the fur brush roller 51 is rotated at the rotational speed Va (550 m/s). Moreover, the controlling part 2 controls so that the photosensitive drums 11 are also rotated at rotational speed VTa corresponding to the intermediate transferring belt 5. At timing T2, the optical scanning device 13 scans the photosensitive drums on the basis of the image data. Since the photosensitive drums 11 are rotated at the rotational speed VTa, operational speed in a sub scanning direction (a vertical scanning direction) of the optical scanning device 13 becomes equal to the speed VTa. At timing T3, scanning of the optical scanning device 13 is finished and operation in the sub scanning direction of the optical scanning device 13 is stopped. In order to fix the toner image onto the sheet S and clean the intermediate transferring belt 5, even after the optical scanning device 13 is stopped, the intermediate transferring belt 5 and fur brush roller 51 are continuously driven.

At timing T4 in FIG. 4A, the controlling part 2 controls so as to stop traveling of the intermediate transferring belt 5 and rotating of the fur brush roller 51. On the other hand, at timing T14 in FIG. 4B, the controlling part 2 controls so that the fur brush roller 51 is rotated at the rotational speed Vb (660 mm/s) with traveling the intermediate transferring belt 5 at the traveling speed VT1. A difference between relative speeds of the intermediate transferring belt 5 and fur brash roller 51 is varied to double speed difference, e.g. from 98 mm/s to 202 mm/s. At timing T15, the controlling part controls so as to stop traveling of the intermediate transferring belt 5 and rotating of the fur brush roller 51. A time from the timing T14 to the timing T15 is 5 seconds. Thus, in a predetermined time from the timing T14 to the timing T15 except for the time of image forming, the fur brush roller 51 is rotated at the rotational speed Vb faster than the rotational speed Va. Since the rotational speed of the fur brush roller 51 rotated with coming into contact with the surface of the intermediate transferring belt 5 is increased, the capacity collecting the toner from the intermediate transferring belt 5 by the fur brush roller 51 is improved. Moreover, because the time traveling the intermediate transferring belt 5 at the rotational speed Vb is restricted to 5 seconds, an influence damaging the intermediate transferring belt 5 by the fur brush roller 51 is hardly caused.

Next, the relationship between the rotational speed of the fur brush roller 51 and the toner accumulated quantity will be described. In a case where the sheet S, onto which the toner image is transferred, is thick, in order to heat the sheet to temperature where the fixing device 16 can fix the toner image, conveying speed of the sheet S is decreased. Therefore, the traveling speed VT1 of the intermediate transferring belt 5 is decreased. Moreover, if the difference between the relative speeds of the intermediate transferring belt 5 and fur brash roller 51 is increased, the fur brash roller 51 may damage the intermediate transferring belt 5. In order to prevent the intermediate transferring belt 5 from being damaged, the rotational speed of the fur brash roller 51 is also decreased. If the rotational speed of the fur brash roller 51 is decreased, the centrifugal force of the fur brash roller 51 is weakened and the toner accumulated quantity held by the fur brush roller 51 is increased. In inverse proportion to the rotational speed of the fur brash roller 51, a toner quantity, which can be held by the fur brash roller 51, is decreased. According to this, as indicated by a solid line L6 in FIG. 3D, if the rotational speed of the fur brash roller 51 is decreased, the threshold quantity THR of the fur brash roller 51 becomes small. For example, it is assumed that, after many thick sheets S are used for transferring the toner image, a thin sheet S is used for transferring the toner image. In order to transfer the toner image onto the many thick sheets S, the controlling part 2 controls so that the fur brash roller 51 is rotated at a half speed of the rotational speed Va. In such a case, the toner accumulated quantity held by the fur brush roller 51 becomes an accumulated quantity P. As indicated by a point P1 in FIG. 3D, the accumulated quantity P of the toner is smaller than the threshold quantity THR. After that, while the toner accumulated quantity of the fur brush roller 51 is kept in this state, in order to transfer the toner image onto the thin sheet S, the controlling part 2 controls so that the fur brash roller 51 is rotated at the rotational speed Va. In such a case, although the accumulated quantity P of the toner is not varied, the threshold quantity THR of the fur brash roller 51 becomes small in accordance with varying the rotational speed of the fur brash roller 51 from the rotational speed ½Va to the rotational speed Va. As indicated by a point P2 in FIG. 3D, the accumulated quantity P of the toner becomes larger than the threshold quantity THR. Therefore, the toner accumulated in the fur brash roller 51 is discharged onto the intermediate transferring belt 5. If the toner is adhered on the intermediate transferring belt 5, the toner image transferred onto the sheet S is soiled by a remained toner and a problem that quality of the formed image is degraded is caused.

Therefore, according to a ratio of the number of transfers of thick sheets S to all sheets S in a certain period when the image forming apparatus 10 forms the image, the controlling part 2 brings forward timing cleaning the fur brash roller 51. In the certain period when forming the image, the number of sheets S onto which the toner image is transferred is defined as a second transfer number (the number of transferred sheets). Among the second transfer number, the number of sheets S with a thickness equal to or larger than a thickness threshold determined in advance is defined as a first transfer number (the number of transferred sheets). The controlling part 2 changes switch timing switching the speed control mode of the fur brash roller 51 from the first speed control mode in the time of image forming to the second speed control mode in the time of cleaning in accordance with a ratio of the first transfer number to the second transfer number. The controlling part 2 brings forward the switch timing when the ratio of the first transfer number to the second transfer number is increased and brings backward the switch timing when the ratio is decreased. In a case where the rotational speed of the fur brush roller 1 is slow, the toner is easily accumulated in the fur brush roller 51 with weakened centrifugal force. Therefore, a time until the toner accumulated quantity reaches the threshold quantity THR corresponding to the rotational speed Va is brought forward. Thereupon, the controlling part 2 brings forward the switch timing switching from the first speed control mode to the second speed control mode in accordance with rotating time while the fur brush roller 51 is rotated at the slow rotational speed. Thereby, to image forming time while the image forming apparatus 10 forms the image, a degree of the time cleaning the fur brush roller 51 is increased. Before the toner accumulated quantity becomes equal to or more than the threshold quantity THR corresponding to the rotational speed of the fur brush roller 51 when the toner image is transferred onto the sheet S with the usual thickness, the toner is removed from the fur brush roller 51. Moreover, the controlling part 2 brings backward the switch timing switching from the first speed control mode to the second speed control mode in accordance with rotating time while the fur brush roller 51 is rotated at the fast rotational speed. Thereby, to image forming time while the image forming apparatus 10 forms the image, a degree of the time cleaning the fur brush roller 51 is decreased. Since timing, at which the toner accumulated quantity becomes equal to or more than the threshold quantity THR corresponding to the rotational speed of the fur brush roller 51 when the toner image is transferred onto the sheet S with the usual thickness, is brought backward, image forming time is lengthened. Thereby, efficiency of image forming of the image forming apparatus 10 is improved. Incidentally, concrete process of the controlling part 2 will be described in the description mentioned later about fur brush roller cleaning process.

The controlling part 2 changes cleaning time rotating the fur brush roller 51 at the rotational speed Vb for cleaning in accordance with a time determined in advance in proportional to the first transfer number. Thereby, it is possible to decrease the toner accumulated quantity of the toner collected from the intermediate transferring belt 5 and held by the fur brush roller 51. Therefore, the capacity collecting the toner from the intermediate transferring belt 5 by the fur brush roller 51 is improved.

Figure 4C:
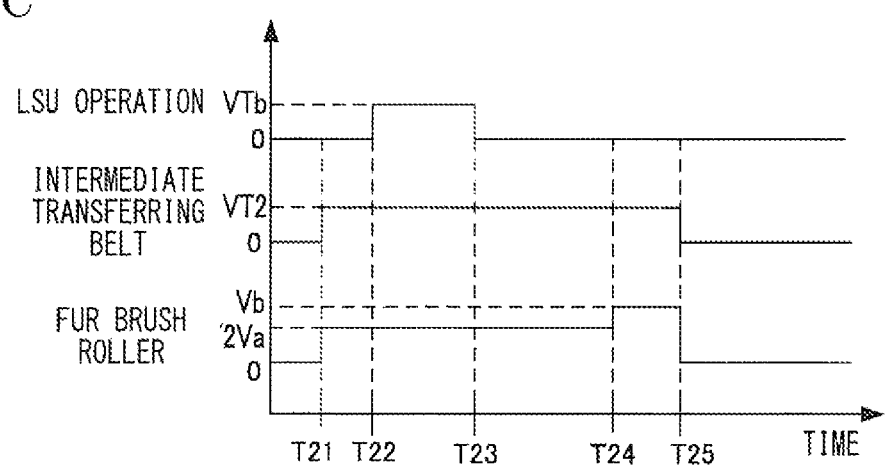

Next, the operation at low speed in the second speed control mode will be described. FIG. 4C is a timing chart in a case where the thick sheet S is conveyed in the first speed control mode. At timing T21, when image forming indication is inputted from the operating/displaying part 25, the controlling part 2 controls by a signal from the torque sensor 62 to travel the intermediate transferring belt 5 and to rotate the fur brush roller 51 so as to correspond to the thick sheet S. The controlling part 2 controls so that the intermediate transferring belt 5 is traveled at traveling speed VT2 (229 mm/s) and the fur brush roller 51 is rotated at the rotational speed ½Va (275 m/s). Moreover, the controlling part 2 controls so that the photosensitive drums 11 are also rotated at rotational speed VTb corresponding to the intermediate transferring belt 5. At timing T22, the optical scanning device 13 scans the photosensitive drums 11 on the basis of the image data. Since the photosensitive drums 11 are rotated at the rotational speed VTb, operational speed in the sub scanning direction of the optical scanning device 13 becomes equal to the speed VTb. At timing T23, scanning of the optical scanning device 13 is finished and operation in the sub scanning direction of the optical scanning device 13 is stopped. In order to fix the toner image onto the sheet S and clean the intermediate transferring belt 5, even after the optical scanning device 13 is stopped, the intermediate transferring belt 5 and fur brush roller 51 are continuously driven.

At timing T24, the controlling part 2 controls so that the fur brush roller 51 is rotated at the rotational speed Vb (660 mm/s) with traveling the intermediate transferring belt 5 at the traveling speed VT2. At timing T25, the controlling part 2 controls so as to stop driving of the intermediate transferring belt 5 and fur brush roller 51. A time from the timing T24 to the timing T25 is 10 seconds. Thus, in a case where the toner image is transferred onto the thick sheet S, a predetermined time from the timing T24 to the timing T25 except for the time of image forming is lengthened more than the case where the toner image is transferred onto the thin sheet S. Since a time rotating the fur brush roller 51 is long, more toner accumulated quantity accumulated in the fur brush roller 51 is removed.

Next, the controlling part 2 will be described. The controlling part 2 integratedly controls the image forming apparatus 10. The controlling part 2 is configured as a microcomputer mainly composed of CPU, ROM, RAM, EEPROM, DRIVER and others. Incidentally, the controlling part 2 may be composed of an electronic circuit, such as an integrated circuit (ASIC, DSP).

The controlling part 2 is connected to each image forming unit 4, the second transferring roller 20, the belt cleaning device 50, the fixing device 16, the driving roller 6A and others inside the image forming apparatus 10 to control these components. The controlling part 2 is connected each element composing the image forming unit 4, concretely, is connected to the charging device 12, the optical scanning device 13, the developing device 14, the first transferring roller 15, the cleaning device 17 and others. In the ROM, program executing image forming process is stored. The CPU executes control program in the ROM to control the components and elements connected to the controlling part 2 so as to print the image onto the sheet (a print paper).

In the first embodiment, the ROM of the controlling par 2, program executing fur brush roller cleaning controlling process mentioned later and others. The CPU executes this program to execute the fur brush roller cleaning process. Moreover, when the CPU executes the program, in the fur brush roller cleaning process, the controlling part 2 works as a second obtaining part 71 (an example of a second obtaining part of the present disclosure), a thickness detecting part 72, a first obtaining part 73 (an example of a first obtaining part of the present disclosure), a rotation controlling part 74 (an example of a rotation controlling part of the present disclosure), a mode switching part 75 (an example of a mode changing part of the present disclosure), a conversion number deciding part 76 (an example of a deciding part of the present disclosure), a charging controlling part 77, a transferring belt controlling part 78, a photosensitive body controlling part 79 and a collecting controlling part 80.

In the ROM, in addition to the program, a voltage value, a current value, the thickness threshold, a corresponding table of the torque value signal and the thickness, a rotational speed, the cleaning time, a first threshold number (an example of a second threshold of the present disclosure), a second threshold number and others are stored. The first threshold number is used for deciding timing changing from the first speed control mode to the second speed control mode. The second threshold number is used for deciding a length of the cleaning time in the second speed control mode. In the EEPROM, a first counter C prepared with the first threshold number, a second counter D prepared with the second threshold number and others are stored. In the RAM, temporary data used for fur brush roller cleaning controlling and others are stored. The DRIVER drives a driving motor driving the intermediate transferring belt 5, the fur brush roller 51, the collecting roller 52, the conveying spiral 54, the photosensitive drum 11 and others.

The second obtaining part 71 obtains the second transfer number being the number of the sheets S onto which the toner image is transferred. For example, the second obtaining part 71 obtains the number of image forming sheets directed from the operating/displaying part 25 or the number of image forming sheets contained in the image data inputted from another information processing device to obtain the second transfer number.

The thickness detecting part 72 obtain thickness information indicating the thickness of the sheet S onto which the toner image is transferred, when the toner image is transferred. For example, the thickness detecting part 72 obtains the torque value signal from the torque sensor 62, when the sheet S is conveyed. The thickness detecting part 72 obtains the thickness information of the sheet S on the basis of the thickness corresponding table and the torque value signal stored in the ROM. Incidentally, the thickness detecting part 72 may obtain the thickness information on the basis of information inputted by operation screen (not shown). Alternatively, the thickness detecting part 72 may obtain the thickness information on the basis of information inputted from information processing device via a printer driver.

The first obtaining part 73 obtains the first transfer number being the number of sheets S with the thickness equal to or larger than the thickness threshold determined in advance, among the sheets S onto the toner image is transferred. The first obtaining part 73 obtains, as the first transfer number, the number of sheets with the thickness information detected by the thickness detecting part 72 equal to or larger than the thickness threshold determined in advance, among the second transfer number obtained by the second obtaining part 71. Concretely, the first obtaining part 73 decides about the sheet S onto which the toner image is transferred whether or not the thickness information is equal to or more than the thickness threshold stored in the ROM, and then, obtains that equal or more than the thickness threshold. For example, the thickness threshold is 136 $g/m^2$ as the thickness of the conveyed sheet S and the first transfer number is the number of the sheets with the thickness equal to or more than 136 $g/m^2$.

The rotation controlling part 74 executes any of the speed control mode in the first speed control mode and the second speed control mode to rotate the fur brush roller 51. The first speed control mode is a mode rotating the fur brush roller 51 and traveling the intermediate transferring belt 5 at speed according to the thickness of the sheet S detected by the thickness detecting part 72, when the toner image is transferred onto the sheet S. It is necessary to lengthen the heating time of the fixing device 16 in accordance with the thickness of the sheet S. The fixing device 16 conveys the sheet S at conveying speed according to the thickness of the sheet S. Therefore, the intermediate transferring belt 5 at a downstream side in a conveying direction from the fixing device 16 is traveled at speed according to the conveying speed of the fixing device 16. According to this, the rotation controlling part 74 rotates the fur brush roller 51 at rotational speed according to the conveying speed. For example, in a case where the thickness of the sheet S is less than the thickness threshold, the rotation controlling part 74 sets the intermediate transferring belt 5 to the traveling speed VT (458 mm/s) and the fur brush roller 51 to the rotational speed Va (550 mm/s). In a case where the thickness of the sheet S is equal to or more than the thickness threshold, the rotation controlling part 74 sets the intermediate transferring belt 5 to the traveling speed VT (229 mm/s) and the fur brush roller 51 to the rotational speed ½Va (275 mm/s). The second speed control mode is a mode rotating the fur brush roller 51 at the rotational speed Va or the rotational speed ½Va set by the rotation controlling part 74. The second speed control mode is a mode rotating the fur brush roller 51 at rotational speed faster than the rotational speed Va or the rotational speed ½Va, when the fur brush roller 51 is cleaned. The rotation controlling part 74 switches from the first speed control mode to the second speed control mode at the switch timing determined in advance.

The rotation controlling part 74 changes the cleaning time while rotating the fur brush roller 51 at the rotational speed Vb, in proportion to the first transfer number. If the first transfer number is increased, a time while rotating the fur brush roller 51 at the rotational speed ½Va is lengthened, and the toner accumulated quantity of the fur brush roller 51 is increased. Therefore, since the rotation controlling part lengthens the cleaning time, the toner accumulated quantity of the fur brush roller 51 is decreased. Because the toner accumulated quantity is decreased, the toner collecting capacity of the fur brush roller 51 is improved.

The rotation controlling part 74 rotates the collecting roller 52 at speed according to the rotational speed of the fur brush roller 51 together with the fur brush roller 51. Thereby, it is possible to prevent a speed difference between the fur brush roller 51 and collecting roller 52 from extending excessively.

The mode switching part 75 changes the switch timing in accordance with the first transfer number obtained by the first obtaining part 73. The larger the first transfer number, the slower rotating the fur brush roller 51, so the toner is easily accumulated in the fur brush roller 51. Therefore, the mode switching part 75 brings forward changing of the switch timing. Moreover, the mode switching part 75 changes the switch timing in accordance with the ratio of the first transfer number to the second transfer number. In such a case, the mode switching part 75 brings forward the switch timing when the ratio of the first transfer number to the second transfer number is increased and brings backward the switch timing when the ratio is decreased. The image forming apparatus 10 forms the image onto the sheet S, even if the sheet S equal to or more than the thickness threshold and the sheet S less than the thickness threshold are mixed and conveyed. Therefore, the mode switching part 75 brings forward changing of the switch timing in accordance with the ratio of the first transfer number indicating the number of sheets S equal to or more than the thickness threshold among the second transfer number indicating all sheets S onto the image is formed. Thereby, the toner accumulated quantity held by the fur brush roller 51 is kept less than the threshold quantity THR.

The conversion number deciding part 76 corrects the first transfer number as the number of all sheets S onto which the image is formed and decides the switch timing. For the purpose, the conversion number deciding part 76 determines a conversion number (the converted number of sheets) by multiplying the first transfer number by coefficient of 1 or more determined in advance. The conversion number deciding part 76 determines the number of sheets S less than the thickness threshold as the different number between the first transfer number and the second transfer number and determines a third transfer number by adding the conversion number to the different number. Incidentally, the coefficient is a ratio of the quantity of the toner held by the fur brush roller 51 when conveying the sheet S equal to or more than the thickness threshold, in a case where the quantity of the toner held by the fur brush roller 51 when conveying the sheet S less than the thickness threshold is assumed as 1. The third transfer number is the number of sheets corrected the second transfer number by converting the first transfer number to the number of sheet S less than the thickness threshold on the basis of the quantity of the toner held by the fur brush roller 51. Thereby, when the image forming apparatus 10 forms the image onto a plurality of sheets S, even if the sheet S equal to or more than the thickness threshold and the sheet S less than the thickness threshold are mixed, it is possible to decide the switch timing. The switch timing is timing when the conversion number deciding part 76 decides the sheets equal to or more than the second threshold number.

The charging controlling part 77 controls timing, a period, a voltage value and others in which the first charging part 55, the charging device 12 and the third charging part 61 apply each bias, in accordance with operation state of the image forming apparatus 10. The charging controlling part 77 controls the first charging part 55 so as to set the first bias applied to the fur brush roller 51 to a reverse polarity to the first charging polarity electrically charged to the toner on the intermediate transferring belt 5. Thereby, since an electrical polarity of the toner on the intermediate transferring belt 5 is reversed to the fur brush roller 51, the remained toner is easily collected by the fur brush roller 51. Moreover, the charging controlling part 77 electrically charges the charging device 12 of the image forming unit 4 for cyan at the downstream side from the belt cleaning device 50 in the traveling (rotating) direction of the intermediate transferring belt 5 when executing the second speed control mode. The second bias electrically charging the photosensitive drum 11 by the charging device 12 is a reversed polarity to the first bias. The charging polarity of almost toner remained on the intermediate transferring belt 5 is the first charging polarity. However, in the remained toner, there is some toner electrically charged to the second charging polarity reversed to the first charging polarity. Therefore, the toner with the reversed polarity non-removed from the intermediate transferring belt 5 by the belt cleaning device 50 may be moved to the photosensitive drum 11 electrically charged to the second bias with the reversed polarity to the first bias. Thereby, the toner electrically charged to the reversed polarity on the intermediate transferring belt 5 is removed. Further, the charging controlling part 77 controls the third charging part 61 so as to apply the third bias reversed to the first bias to the intermediate transferring belt 5. The toner on the intermediate transferring belt 5 electrically charged by the third bias is electrically charged to the first charging polarity. Therefore, by the belt cleaning device 50 at the downstream side, since the toner electrically charged to the first charging polarity has a polarity reversed to the fur brush roller 51 to which the first bias is applied, the toner is easily collected by the fur brush roller 51.

The transferring belt controlling part 78 controls traveling of the intermediate transferring belt 5 in the first speed control mode and the second speed control mode. The transferring belt controlling part 78 controls so that the intermediate transferring belt 5 is traveled at speed corresponding to the rotational speed of the fur brush roller 51. Particularly, in a case where the fixing device 16 fixes the toner image onto the thick sheet S, the conveying speed becomes slow. Therefore, the transferring belt controlling part 78 travels the intermediate transferring belt 5 at speed corresponding to the conveying speed.

The photosensitive body controlling part 79 controls rotating of the photosensitive drum 11 in the first speed control mode and the second speed control mode. The photosensitive body controlling part 79 controls so that the photosensitive drum 11 is rotated at speed corresponding to the rotational speed of the fur brush roller 51. Particularly, the photosensitive body controlling part 79 rotates the photosensitive drum 11, to which the second bias is applied by the charging device 12, at speed corresponding to the rotational speed of the fur brush roller 51, thereby moving the toner with the reversed polarity on the intermediate transferring belt 5 to the photosensitive drum 11.

The collecting controlling part 80 controls operation of the cleaning device 17 in the first speed control mode and the second speed control mode. The collecting controlling part 80 controls so that the cleaning device 17 collects the toner adhered on the surface of the photosensitive drum 11.

Figure 6:
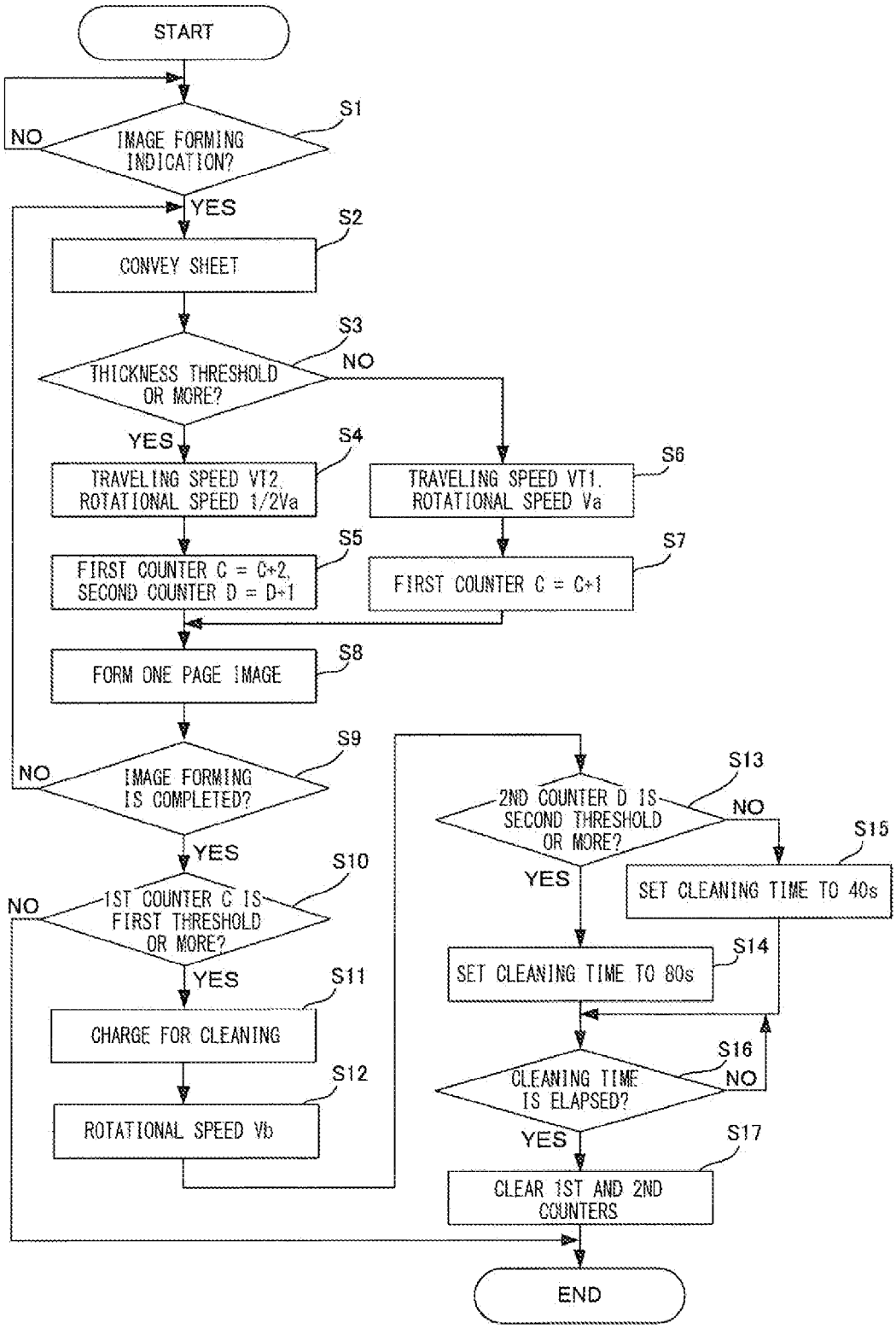
FIG. 6 is a flow chart of an example of cleaning mode process executed by the controlling part of the image forming apparatus.

In the following, with reference to FIG. 6, the procedures of the fur brush roller cleaning process executed by the controlling part 2 in the first embodiment will be described. In a flow chart of FIG. 6, step S1, step S2 and so on indicate numbers of respective procedures (steps). Incidentally, a condition executing the fur brush roller cleaning process by the controlling part 2 is decided when the image forming apparatus 10 executes image forming process. If the condition is satisfied, the controlling part 2 changes from the first speed control mode to the second speed control mode to carry out cleaning process of the fur brush roller 51. Here, the controlling part 2 executing the fur brush roller cleaning process corresponds to the first obtaining part, the mode changing part, the second obtaining part, the deciding part and the rotation controlling part according to the present disclosure.

In step S1, the controlling part 2 decides whether or not the image forming indication of the image forming apparatus 10 is inputted. The image forming indication contains information, such as the original image data for the toner image and the second transfer number indicating the number of sheets S onto which the toner image is transferred and the image is formed. For example, the controlling part 2 decides whether or not indication, such as copy or print, from the user is inputted. At that time, the controlling part 2 obtains the second transfer number indicating the number of sheets S contained in the image forming indication. The controlling part 2 waits until the image forming indication is inputted (step S1: NO). By contrast, the image forming indication is inputted to the controlling part 2, the process is shifted to step S2 (step S1: YES).

In step S2, the controlling part 2 conveys the sheet S onto which the toner image is transferred and the image is formed. At that time, the torque sensor 62 detects the driving torque of the intermediate conveying roller 24 and the torque signal corresponding to the driving torque to the controlling part 2, when the sheet S is conveyed. The torque signal is information indication the thickness of the sheet S. Therefore, the controlling part 2 obtains the torque signal of the sheet S to be transferred when the toner image is transferred. After that, the process is shifted to step S3.

In step S3, the controlling part 2 decides whether or not the thickness indicated by the torque signal is equal to or more than the thickness threshold. For example, the controlling part 2 decides whether or not a signal level indicated by the torque signal is equal to or more than a standard signal level corresponding to the thickness threshold (136 $g/m^2$). If it is decided that the thickness is equal to or more than the thickness threshold, the controlling part 2 shifts the process to step S4 (step S3: YES). On the other hand, if it is decided that the thickness is less than the thickness threshold, the controlling part 2 shifts the process to step S6 (step S3: NO).

In step S4, the controlling part 2 sets the traveling speed VT2 of the intermediate transferring belt 5 and the rotational speed ½Va of the fur brush roller 51. Thereby, the controlling part 2 can obtain a time while the sheet S is heated to fixing temperature, when the sheet S equal to or more than the thickness threshold is passed through the fixing device 16. After that, the process is shifted to step S5. In step S5, the controlling part 2 adds 2 into a value of the first counter C used for deciding a period while the fur brush roller 51 is shifted from the first speed control mode to the second speed control mode. Thereby, the controlling part 2 adds the conversion number, which is determined by multiplying the first transfer number indicating the number of sheets S equal to or more than the thickness threshold by coefficient of 1 or more determined in advance, into the first counter C. Moreover, in step S5, the controlling part 2 adds 1 into a value of the second counter D counting the first transfer number. Thereby, the controlling part 2 obtains the first transfer number indicating the number of sheets S equal to or more than the thickness threshold. The controlling part 2, after step S5 is executed, shifts the process to step S8. Incidentally, the controlling part 2 executing steps S4 and S5 corresponds to the first obtaining part of the present disclosure.

In step S3, if it is decided that the thickness is less than the thickness threshold (step S3: NO), in step S6, the controlling part 2 sets the traveling speed VT1 of the intermediate transferring belt 5 and the rotational speed Va of the fur brush roller 51. Thereby, the controlling part 2 can prevent the sheet S from being heated excessively, when the sheet S less than the thickness threshold is passed through the fixing device 16. After that, the process is shifted to step S7. In step S7, the controlling part 2 adds 1 into the value of the first counter C and shifts the process to step S8. Thereby, the controlling part 2 adds the number of sheets S less than the thickness threshold into the first counter C. Incidentally, the controlling part 2 executing steps S6 and S7 corresponds to the second obtaining part of the present disclosure.

In step S8, the controlling part 2 controls so as to transfer the toner image based on the image data onto the sheet S and to form the image for one page onto the sheet S. Meanwhile, the controlling part 2 rotates the fur brush roller 51 at the rotational speed ½Va set in step S4 or at the rotational speed Va set in step S6. Moreover, the controlling part 2 travels the intermediate transferring belt 5 at the traveling speed VT2 set in step S4 or at the traveling speed VT1 set in step S6. Since the intermediate transferring belt 5 and fur brush roller 51 are driven, the toner is collected and held by the fur brush roller 51. Therefore, the toner accumulated quantity of the fur brush roller 51 is increased. After that, the process is shifted to step S9. In step S9, the controlling part 2 decides whether or not image forming on the basis of the indicated image data is completed. Concretely, the controlling part 2 decides whether or not the number of sheets S after image forming reaches the number of sheets on the basis of the image forming indication. If it is decided that the number of sheets S after image forming does not reach the number of sheets on the basis of the image forming indication (step S9: No), the controlling part 2 shifts the process to step S2. By contrast, if it is decided that the number of sheets S after image forming reaches the number of sheets on the basis of the image forming indication (step S9: YES), the controlling part 2 shifts the process to step S10. Thus, the controlling part 2 forms the image onto the sheet S until the number of sheets S after image forming reaches the number of sheets on the basis of the image forming indication.

In step S10, the controlling part 2 decides whether or not the value of the first counter C is equal to or more than the first threshold number. Because, to the value of the first counter C, the conversion number is added in step S5 and the number of sheets less than the thickness threshold is added in step S7, the value of the first counter C indicates the third transfer number after corrected. If it is decided that the value of the first counter C is less than the first threshold number (step S10: NO), the controlling part 2 finishes the process. In such a case, the controlling part 2 finishes the image forming process with keeping the first speed control mode. By contrast, if it is decided that the value of the first counter C is equal to or more than the first threshold number (step S10: YES), the controlling part 2 shifts the process to step S11. Thereby, the controlling part 2 switches the speed control mode from the first speed control mode to the second speed control mode. Thus, the controlling part 2 brings forward the switch timing when the ratio of the first transfer number to the second transfer number is increased and brings backward the switch timing when the ratio is decreased. Incidentally, the controlling part 2 executing step S10 corresponds to the deciding part of the present disclosure. Moreover, the controlling part 2 shifting the process to step S11 corresponds to the mode changing part of the present disclosure.

In step S11, the controller 2 controls electrical charging of the first charging part 55, the charging device 12 and the third charging part 61 by each bias. In such a case, to the fur brush roller 51, the first bias is applied by the first charging part 55. To the photosensitive drum 11, the second bias is applied by the charging device 12. To the toner at the upstream side from the belt cleaning device 50 in the traveling (rotating) direction on the intermediate transferring belt 5, the third bias is applied. Thereby, the controlling part 2 controls so that the toner remained on the intermediate transferring belt 5 is easily collected by the belt cleaning device 50. Moreover, the controlling part 2 controls so that the toner electrically charged to the reversed polarity and non-collected by the belt cleaning device 50 can be moved to the photosensitive drum 11 at the downstream side. After that, the process is shifted to step S12.

In step S12, the controlling part 2 sets the rotational speed of the fur brush roller 51 to the rotational speed Vb. The controlling part 2 sets from the rotational speed of the fur brush roller 51 in the first speed control mode to the faster rotational speed Vb. Thereby, the toner is easily collected from the intermediate transferring belt 5 by the fur brush roller 51. After that, the process is shifted to step S13.

In step S13, the controlling part 2 decides whether or not the value of the second counter D is equal to or more than the second threshold number determined in advance. The value of the second counter D is the first transfer number indicating the number of sheets S equal to or more than the thickness threshold. The controlling part 2 decides whether or not the number of sheets S equal to or more than the thickness threshold is equal to or more than the second threshold number as standard. If it is decided the number of sheets S is equal to or more than the second threshold number (step S13: YES), the controlling part 2 shifts the process to step S14. In step S14, the controlling part 2 sets the cleaning time to 80 seconds. In such a case, because the toner accumulated quantity of the fur brush roller 51 is large, the controlling part 2 decides that the toner accumulated quantity does not become sufficiently smaller than the threshold quantity THR unless the rotational times of the fur brush roller 51 is increased. After that, the process is shifted to step S16. By contrast, if it is decided the number of sheets S is less than the second threshold number (step S13: NO), the controlling part 2 shifts the process to step S15. In step S15, the controlling part 2 sets the cleaning time to 40 seconds. In such a case, because the toner accumulated quantity of the fur brush roller 51 is not large, the controlling part 2 decides that the toner accumulated quantity can become sufficiently smaller than the threshold quantity THR without increasing the rotational times of the fur brush roller 51. After that, the process is shifted to step S16. Thus, the controlling part 2 changes the cleaning time while the fur brush roller 51 is rotated at the rotational speed Vb in accordance with a time determined in proportional to the first transfer number.

In step S16, the controlling part 2 decides whether or not a driving time while the driving motor 58 rotates the fur brush roller 51 at the rotational speed Vb reaches the cleaning time. The controlling part 2 waits until the cleaning time is elapsed (step S16: NO). By contrast, if it is decided that the cleaning time is elapsed (step S16: YES), the controlling part 2 stops rotating of the fur brush roller 51 and shifts the process to step S17. Thus, the controlling part 2 rotates the fur brush roller 51 at the rotational speed Vb at the predetermined timing except for the time of image forming. Incidentally, the controlling part 2 executing steps S4, S6, S8, S10 and S12-S16 corresponds to the rotation controlling part of the present disclosure.

In step S17, the controlling part 2 clears the values of the first counter C and the second counter D and finishes the process.

As described above, according to the image forming apparatus 10 of the present procedure, it is possible to change the switch timing switching from the first speed control mode in the time of image forming to the second speed control mode in the time when cleaning the fur brush roller 51 except for the time of image forming, in accordance with the thickness of the sheet S in the time of image forming. Moreover, according to the image forming apparatus 10 of the present procedure, it is possible to change the cleaning time while the fur brush roller 51 is rotated in the second speed control mode, in accordance with the thickness of the sheet S in the time of image forming. Thereby, it is possible to prevent the toner accumulated quantity of the fur brush roller 51 from being increased excessively and to remove the toner on the intermediate transferring belt 5. That is, by changing the switch timing from image forming mode to cleaning mode in accordance with the thickness of the sheet in the time of image forming, it is possible to maintain the collecting capacity removing the toner from the intermediate transferring belt 5 by the fur brush roller 51.

Next, a modified example of the first embodiment will be described. In the description of the first embodiment, although the number of prints contained in the image forming indication is used for obtaining the second transfer number as the number of sheets S and the torque sensor 62 is used for obtaining the thickness information of the sheet S, the content of the present disclosure is not restricted by these. For example, the controlling part 2 may obtain the second transfer number from the driving torque detected by the torque sensor 62. Moreover, the thickness information of the sheet S may be contained in the content of the image forming indication inputted by the user. In such a case, the controlling part 2 may obtain thickness information of the sheet S from the image forming indication. Alternatively, the image forming apparatus 10 includes a plurality of sheet feeding cartridges 30 storing the sheets S with different thicknesses. In such a case, a controlling part 2 may obtain the thickness information of the sheet S on the basis of the sheet feeding cartridge 30 selected in image forming. Alternatively, an actuator with rotation angle varied in accordance with the thickness information of the conveyed sheet S may be arranged in the conveying path 26 and the image forming apparatus 10 may obtain the thickness information of the sheet S from the rotation angle of the actuator.

In the description of the first embodiment, although the first threshold number is used for deciding the switch timing switching from the first speed control mode to the second speed control mode, the content of the present disclosure is not restricted by this. For example, the first counter C may count the number of sheets S regardless of the thickness of the conveyed sheet S to compare the count with the first threshold number. However, the controlling part 2 may subtract the first threshold number in accordance with the value of the second counter D of the number of sheets. In such a case, the controlling part 2 may change the switch timing in accordance with the number of sheets S equal to or more than the thickness threshold. For example, between a case where the toner image is formed onto the sheet S equal to or more than the thickness threshold and a case where the toner image is formed onto the sheet S less than the thickness threshold, different thresholds may be used.

Although one sheet S less than the thickness threshold is treated so as to add 1 to the first counter C and one sheet S equal to or more than the thickness threshold is treated so as to add 2 to the first counter C, treatment of the sheet is not restricted by these. For example, one sheet S less than the thickness threshold may be treated so as to add 2 to the first counter C and one sheet S equal to or more than the thickness threshold may be treated so as to add 3 to the first counter C. Thus, although, in a case of the first embodiment, the first transfer number is converted by coefficient of 2, in the above-mentioned example, the first transfer number is converted by coefficient of 1.5. Further, in a case where the value of the first counter C is less than half of the first threshold number, one sheet S equal to or more than the thickness threshold may be treated so as to add 2 to the first counter C and, in a case where the value of the first counter C is equal to or more than half of the first threshold number, one sheet S equal to or more than the thickness threshold may be treated so as to add 3 to the first counter C. Thus, as the threshold quantity THR of the fur brush roller 51 is decreased, an influence of the toner accumulated quantity due to the sheet S equal to or more than the thickness threshold may become significant. Thereby, the image forming apparatus 10 can securely prevent the toner from moving from the fur brush roller 51 to the intermediate transferring belt 5 in reverse.

In the description of the first embodiment, although a case where the cleaning time in the second speed control mode is distinguished according to whether or not the second counter D is equal to or more than the second threshold is described, the content of the present disclosure is not restricted by this. For example, the controlling part 2 may change the cleaning time in accordance with the value of the second counter D to the value of the first counter C. Alternatively, the controlling part 2 may change the cleaning time while rotating the fur brush roller 51 at the rotational speed Vb in the second speed control mode after the switch timing in inverse proportion to the rotational speed of the fur brush roller 51 in the first speed control mode immediately before the switch timing. In the flow chart of the first embodiment, it is decided whether or not the first counter C is equal to or more than the first threshold number after image forming is completed. Suppose in a case where the value of the first counter C is slightly smaller than the first threshold in the last fur brush roller cleaning process (step S10: NO), the fur brush roller 51 is not cleaned. After that, if the image forming apparatus 10 prints many sheets S equal to or more than the thickness threshold, there is provability that the toner accumulated quantity of the fur brush roller 51 significantly exceeds the threshold quantity THR. Therefore, the controlling part 2 may change the cleaning time in the second speed control mode in accordance with the immediately preceding rotational speed of the fur brush roller 51 in the first speed control mode. For example, in the first speed control mode immediately before changing to the second speed control mode, in a case where the fur brush roller 51 is rotated at the rotational speed Va, the rotation controlling part 74 sets the cleaning time to 7.5 seconds in the second speed control mode. Moreover, in a case where the fur brush roller 51 is rotated at the rotational speed ½Va, the rotation controlling part 74 sets the cleaning time to 10 seconds in the second speed control mode.

In the description of the first embodiment, although a case where the charging controlling part 77 applies each bias to the first charging part 55, the charging device 12 and the third charging part 61 is described, the present disclosure is not restricted by this. As long as the charging controlling part 77 applies voltage to the fur brush roller 51 in the second speed control mode, it may be simply configured without applying voltage to the charging device 12 and the third charging part 61.

Next, with reference to the accompanying drawings, a second embodiment of the present disclosure will be described. An image forming apparatus 10 according to the second embodiment of the present disclosure has the similar configuration to the image forming apparatus 10 according to the first embodiment as shown in FIG. 1. Therefore, the description of the configuration of the image forming apparatus 10 except for difference is omitted. A belt cleaning device 50 and its peripheral devices of the image forming apparatus 10 according to the second embodiment of the present disclosure has the similar configuration to the belt cleaning device 50 and its peripheral devices of the image forming apparatus 10 according to the first embodiment as shown in FIG. 2. Therefore, the description of the configuration of the belt cleaning device 50 and its peripheral devices except for difference is omitted.

Figure 8:
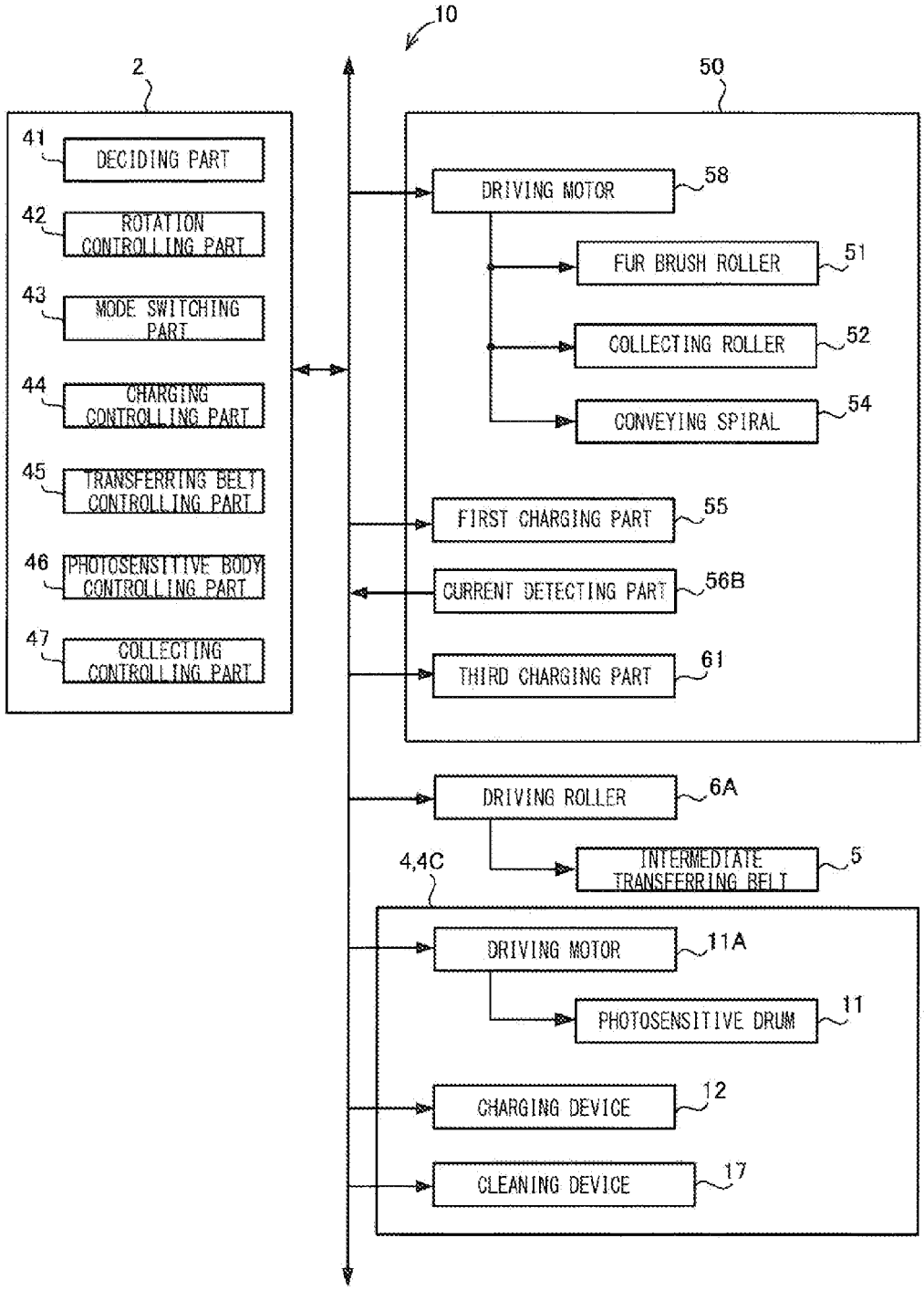
FIG. 8 is a block diagram schematically showing structure of a controlling part of the image forming apparatus.

In the second embodiment, as shown in FIGS. 2 and 8, the belt cleaning device 50 includes a current detecting part 56B, in addition to the fur brush roller 51 (an example of the cleaning member of the present disclosure), the collecting roller 52 (an example of the collecting member of the present disclosure), the cleaning blade 53 (an example of the scraping member of the present disclosure), the conveying spiral 54, the first charging part 55 (an example of the first voltage applying part of the present disclosure), the driving motor 58 (an example of the driving motor of the present disclosure) and the third charging part 61 (an example of the third voltage applying part of the present disclosure).

The current detecting part 56B detects a current quantity of a current flowing from the first charging part to the collecting roller 52. In other words, the current detecting part 56B detects a current quantity of a current flowing from the first charging part 55 to the fur brush roller 51 via the collecting roller 52. If brush bristles 51B are worn, an area coming into contact with the intermediate transferring belt 5 is narrowed and electric resistance is increased. Therefore, in a case where the first bias of the first charging part 55 is maintained at constant, the current quantity flowing from the first charging part 55 to the collecting roller 52 is decreased. The current detecting part 56B is a current detecting circuit composed of electric elements, such as internal resistance and internal capacitor and is configured so that resistance is inserted into a current path between a terminal of the first charging part 55 and a terminal of the collecting roller 52 in series to measure the current from potential difference between the front and back of the resistance. The current detecting part 56B is connected with the controlling part 2 and a detected value (a current value) detected by the current detecting part 56B is outputted to the controlling part 2. The controlling part 2 decides a wear amount of the brush bristles 51B on the basis of variation of the current value of the current flowing from the first charging part 55 to the fur brush roller 51 via the collecting roller 52.

The toner accumulated quantity in the fur brush roller 51 of the image forming apparatus 10 according to the second embodiment has the similar property to the toner accumulated quantity in the fur brush roller 51 of the image forming apparatus 10 according to the first embodiment as shown in FIGS. 3A and 3B. Therefore, the description of the property of the toner accumulated quantity in the fur brush roller 51 except for difference is omitted. Values Va and Vb in FIG. 3B indicate the rotational speeds of the fur brush roller 51. When any mode of an image forming mode or a cleaning mode is executed by the controlling part 2 as described later, the rotational speed of the fur brush roller 51 is switched. The rotational speed Vb (an example of the second rotational speed of the present disclosure) of the fur brush roller 51 in the time of cleaning is a speed faster than the rotational speed Va (an example of the first rotational speed of the present disclosure) of the fur brush roller 51 in the time of image forming. The image forming mode is a mode executed by the controlling part 2 when the image forming apparatus 10 transfers the toner image onto the sheet S from the intermediate transferring belt 5 to form the image. The cleaning mode is a mode executed by the controlling part 2 when the fur brush roller 51 is rotated so that the toner held by the fur brush roller 51 can be removed in the time of cleaning for a time of image forming.

Next, wear of the fur brush roller 51 will be described. Because the brush bristles 51B of the fur brush roller 51 are rotated with coming into contact with the intermediate transferring belt 5, the brush bristles 51B are gradually worn by contact friction. If the fur brush roller 51 with the worn brush bristles 51B is rotated at the similar rotational speed to a non-worn state, the wear of the brush bristles 51B is progressed and the intermediate transferring belt 5 is damaged. Thereupon, in the second embodiment, the controlling part 2 changes the rotational speed of the fur brush roller 51 in accordance with the wear amount of the brush bristles 51B. The controlling part 2 sets the rotational speed Va and the rotational speed Vb of the fur brush roller 51 to speed determined in inverse proportion to the wear amount of the brush bristles 51B. Concretely, the controlling part 2 lowers the rotational speed of the fur brush roller 51 as the wear amount is increased. Thereby, the brush bristles 51B are restrained from being worn further. Moreover, it prevents the top of the brush bristles 51B from becoming sharp by the wear and from coming into strong contact with the intermediate transferring belt 5. Incidentally, concrete process of the controlling part 2 will be described in the fur brush roller cleaning process mentioned later.

If the rotational speed of the fur brush roller 51 is lowered, the toner accumulated quantity of the fur brush roller 51 is increased. As compared with before the wear of the brush bristles 51B, after the wear, because an area where the brush bristles 51B hold the toner is narrowed and holding capacity is deteriorated, the toner held by the fur brush roller 51 is easily moved to the intermediate transferring belt 5. Thereupon, in the second embodiment, the controlling part 2 sets the cleaning time while the fur brush roller 51 is rotated at the rotational speed Vb in the time of cleaning to a time determined in proportion to the wear amount of the brush bristles 51B. Concretely, the controlling part 2 lengthens the cleaning time as the wear amount is increased. Thereby, it is possible to decrease the toner accumulated quantity of the toner held by the fur brush roller 51. As a result, it is possible to decrease a quantity of the toner moved from the fur brush roller 51 to the intermediate transferring belt 5 in reverse.

A table in FIG. 7 indicates degrees that toner soil occurs when the predetermined number of sheets are printed by coverage rate of 5 percent and 20 percent, with regard to two cases, in which a case where the cleaning time is not varied and is maintained at constant and a case where the cleaning time is increased according to the wear amount. In FIG. 7, conditions except for the cleaning time are aligned and results in a case where the traveling speed of the intermediate transferring belt 5 is 458 mm/s, the rotational speed of the fur brush roller 51 in the image forming mode is 550 mm/s and the rotational speed of the fur brush roller 51 in the cleaning mode is 660 mm/s are indicated. According to the table shown in FIG. 7, in a case where the cleaning time is constant 5 seconds and the coverage rate is 5 percent, even if the number of prints reaches 600 k (here, k means one thousand sheets), degradation of image quality due to the toner soil is not caused. In a case where the cleaning time is constant 5 seconds and the coverage rate is 20 percent, if the number of prints reaches 200 k, the toner soil is caused in one sheet among 100-3000 sheets and the image quality is degraded, and moreover, if the number of prints reaches 300 k, the toner soil is caused in one sheet among 100 sheets and degradation of the image quality is remarkable. On the other hand, in a case where the cleaning time is increased from 5 seconds to 10 seconds in accordance with the wear amount and the coverage rate is 5 percent, even if the number of prints reaches 600 k, degradation of image quality due to the toner soil is not caused. In a case where the cleaning time is increased from 5 seconds to 10 seconds in accordance with the wear amount and the coverage rate is 20 percent, if the number of prints reaches 600 k, the toner soil is caused in one sheet among 100-3000 sheets and the image quality is degraded. Thus, since, in a case where the coverage rate is high and the toner accumulated quantity held by the fur brush roller 51 is large, the cleaning time is increased according to the wear amount and the margin capacity is increased, it is possible to prevent the image quality from being degraded due to occurrence of the toner soil.

Since the controlling part 2 changes timing switching from the image forming mode to the cleaning mode in the image forming apparatus in proportion to the wear amount of the brush bristles 51B, it is possible to decrease the toner accumulated quantity held by the fur brush roller 51. If the timing from the image forming mode to the cleaning mode is brought forward, in the image forming apparatus 10, a time executing the cleaning mode is lengthened with regard to a time executing the image forming mode. In the image forming mode, the toner is collected from the intermediate transferring belt 5 and held by the fur brush roller 51. In the cleaning mode, the toner held by the fur brush roller 51 is adhered on the surface of the collecting roller 52 and removed. Therefore, before the toner accumulated quantity of the toner collected from the intermediate transferring belt 5 and held by the fur brush roller 51 exceeds the threshold quantity THR, the toner is removed from the fur brush roller 51.

The controlling part 2 of the image forming apparatus 10 according to the second embodiment of the present disclosure has the similar configuration to the controlling part 2 of the image forming apparatus 10 according to the first embodiment. Therefore, the description of the configuration of the controlling part 2 except for difference is omitted. In the second embodiment, the ROM of the controlling par 2, program executing fur brush roller cleaning controlling process mentioned later and others. The CPU executes this program to execute the fur brush roller cleaning process. Moreover, when the CPU executes the program, in the fur brush roller cleaning process, the controlling part 2 works as a deciding part 41 (an example of the deciding part of the present disclosure), a rotation controlling part 42 (an example of the rotation controlling part of the present disclosure), a mode changing part 43 (an example of the mode changing part of the present disclosure), a charging controlling part 44, a transferring belt controlling part 45, a photosensitive body controlling part 46 and a collecting controlling part 47.

In the ROM, in addition to the program, a voltage value, a current value, the thickness threshold, a corresponding table of the wear amount and the current value, a rotational speed, a rotating time, a threshold number and others are stored. For example, in order to the wear amount of the brush bristles 51B of the fur brush roller 51 by the deciding part 41, the corresponding table used for deciding the wear amount from the voltage value and the current value is stored in the ROM. Incidentally, in the EEPROM, the number of prints formed onto the sheets in the image forming mode and others are stored. In the RAM, temporary data used for fur brush roller cleaning controlling and others are stored. The DRIVER drives a driving motor driving the intermediate transferring belt 5, the fur brush roller 51, the collecting roller 52, the conveying spiral 54, the photosensitive drum 11 and others.

The deciding part 41 decides the wear amount of the brush bristles 51B of the fur brush roller 51 coming into contact with the intermediate transferring belt 5. For example, if the brush bristles 51B of the fur brush roller 51 are worn, a contact area between the brush bristles 51B and the intermediate transferring belt 5 is narrowed. By narrowing of the contact area, electric resistance between the fur brush roller 51 and the intermediate transferring belt 5 is increased. The first charging part 55 applies the first bias to the fur brush roller 51 via the collecting roller 52. Suppose the first bias is set constant, the current value of the current flowed from the first charging part 55 to the fur brush roller 51 via the collecting roller 52 is lowered. Thereupon, the deciding part 41 decides the wear amount of the brush bristles 51B on the basis of variation of the current value of the current flowed from the first charging part 55 to the fur brush roller 51. Measured point may be the collecting roller 52 except for the fur brush roller 51. That is, the deciding part 41 decides the wear amount of the brush bristles 51B on the basis of variation of the current value of the current flowed from the first charging part 55 to the collecting roller 52.

The rotation controlling part 42 changes the rotational speed of the fur brush roller 51 in accordance with the wear amount of the brush bristles 51B decided by the deciding part 41. As the wear amount of the brush bristles is increased, the rotation controlling part 42 decreases the current value flowed to the driving motor 58 and changes the rotational speed of the fur brush roller 51 slow. The rotation controlling part 42 rotates the fur brush roller 51 at the rotational speed Va in the image forming mode and rotates the fur brush roller 51 at the rotational speed Vb in the cleaning mode. The rotational speed Vb is speed determined in inverse proportion to the wear amount of the brush bristles 51B. Since the rotational speed Vb is lowered in accordance with the wear amount, it prevents the top of the brush bristles 51B from becoming sharp by the wear and from coming into strong contact with the intermediate transferring belt 5. Moreover, the rotation controlling part 42 changes the rotational speed of the fur brush roller 51 in accordance with the wear amount and changes the cleaning time while the fur brush roller 51 is rotated at the rotational speed Vb in inverse proportion to the wear amount of the brush bristles 51B. Thereby, since the rotational speed Vb is lowered in accordance with the wear amount of the brush bristles 51B, it is possible to decrease the toner accumulated quantity held by the fur brush roller 51. Thus, by combining lowering of the rotational speed Vb according to the wear amount of the brush bristles 51B and increasing of the cleaning time, it is possible to prevent the intermediate transferring belt 5 from being damaged and to prevent the image quality from being degraded according to reverse movement of the toner.

The mode changing part 43 changes timing of switching from the image forming mode to the cleaning mode by the rotation controlling part 42 in proportion to the wear amount of the brush bristles 51B. If the rotational speed of the fur brush roller 51 is lowered by the rotation controlling part 42, a time when the toner accumulated quantity of the toner held by the fur brush roller 51 reaches the threshold quantity THR is brought forward. Therefore, in accordance with the wear amount of the brush bristles 51B, by switching from the image forming mode to the cleaning mode by the mode changing part 43, it is possible to maintain the toner accumulated quantity of the toner held by the fur brush roller 51 to the threshold quantity THR or less.

The charging controlling part 44 controls timing, a period, a voltage value and others in which the first charging part 55, the charging device 12 and the third charging part 61 apply each bias, in accordance with operation state of the image forming apparatus 10. The charging controlling part 44 controls the first charging part 55 so as to set the first bias applied to the fur brush roller 51 to a reverse polarity to the first charging polarity of the toner on the intermediate transferring belt 5. Thereby, since an electrical polarity of the toner on the intermediate transferring belt 5 is reversed to the fur brush roller 51, the toner is easily collected by the fur brush roller 51. Moreover, the charging controlling part 44 electrically charges the charging device 12 of the image forming unit 4 for cyan at the downstream side from the belt cleaning device 50 in the traveling (rotating) direction of the intermediate transferring belt 5 when the rotation controlling part 42 executes the cleaning mode. The second bias electrically charging the photosensitive drum 11 by the charging device 12 is a reversed polarity to the first bias. The charging polarity of almost toner remained on the intermediate transferring belt 5 is the first charging polarity. However, in the remained toner, there is some toner electrically charged to the second charging polarity reversed to the first charging polarity. Therefore, the toner with the reversed polarity non-removed from the intermediate transferring belt 5 by the belt cleaning device 50 may be moved to the photosensitive drum 11 electrically charged to the second bias with the reversed polarity to the first bias. Thereby, the toner electrically charged to the reversed polarity on the intermediate transferring belt 5 is removed. Further, the charging controlling part 44 controls the third charging part 61 so as to apply the third bias with the reversed polarity to the first bias when the rotation controlling part 42 executes the cleaning mode. The toner on the intermediate transferring belt 5 electrically charged by the third bias is electrically charged to the first charging polarity. Therefore, by the belt cleaning device 50 at the downstream side, since the toner electrically charged to the first charging polarity has a polarity reversed to the fur brush roller 51 to which the first bias is applied, the toner is easily collected by the fur brush roller 51.

The transferring belt controlling part 45 controls traveling of the intermediate transferring belt 5 in the image forming mode and the cleaning mode. The transferring belt controlling part 45 controls so that the intermediate transferring belt 5 is traveled at speed determined in advance.

The photosensitive body controlling part 46 controls rotating of the photosensitive drum 11 in the image forming mode and the cleaning mode. The photosensitive body controlling part 46 controls so that the photosensitive drum 11 is rotated at speed determined in advance. Particularly, the photosensitive body controlling part 46 rotates the photosensitive drum 11, to which the second bias is applied by the charging device 12, in the cleaning mode, thereby moves the toner with the reversed polarity on the intermediate transferring belt 5 to the photosensitive drum 11.

The collecting controlling part 47 controls operation of the cleaning device 17 in the image forming mode and the cleaning mode. The collecting controlling part 47 controls so that the cleaning device 17 collects the toner adhered on the surface of the photosensitive drum 11.

Figure 9:
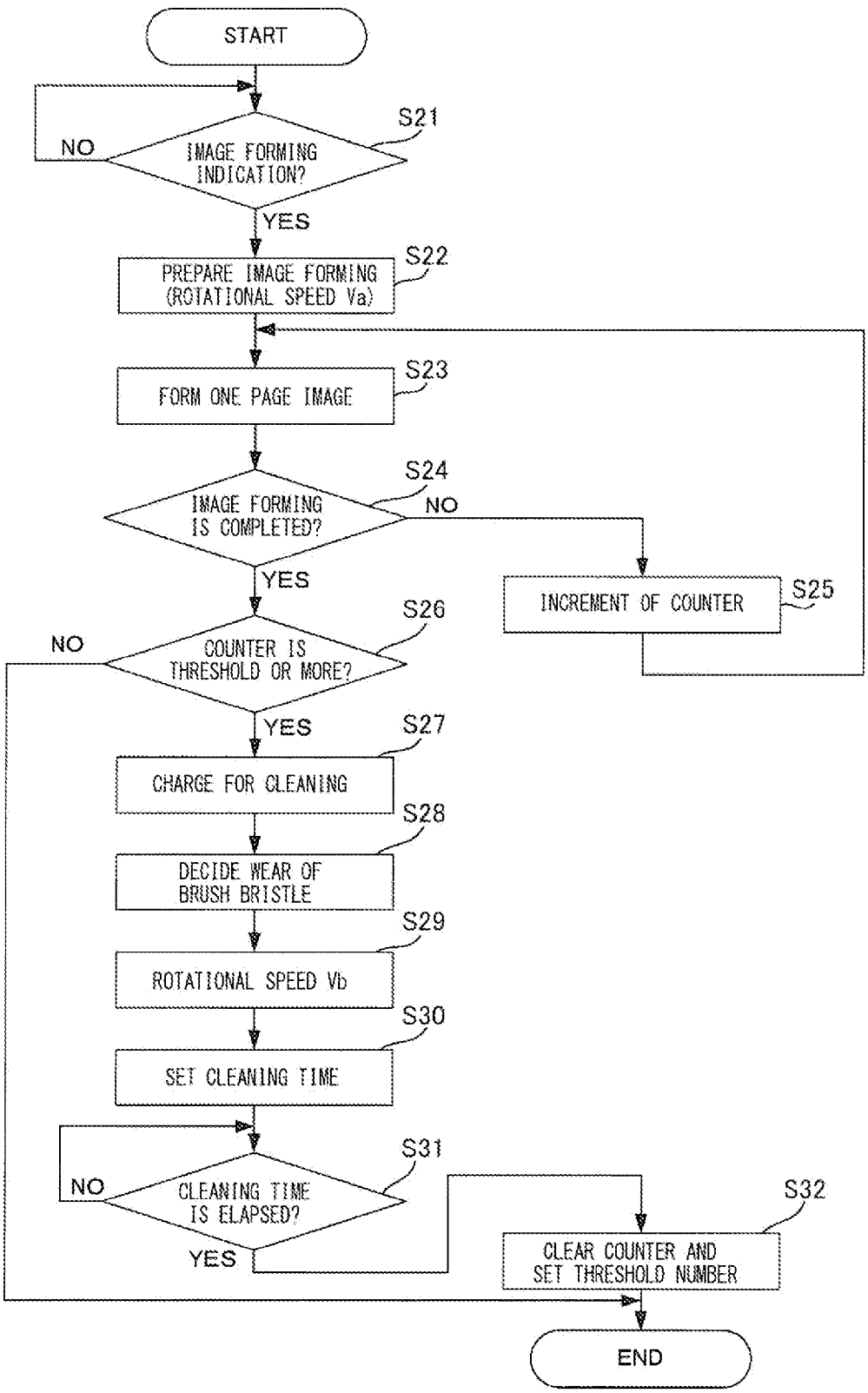
FIG. 9 is a flow chart of an example of cleaning mode process executed by the controlling part of the image forming apparatus.

In the following, with reference to FIG. 9, the procedures of the fur brush roller cleaning process executed by the controlling part 2 in the second embodiment will be described. In a flow chart of FIG. 9, step S21, step S22 and so on indicate numbers of respective procedures (steps). Incidentally, a condition executing the fur brush roller cleaning process by the member is a brush roller hcided when the image forming apparatus 10 executes image forming process. If the condition is satisfied, the controlling part 2 changes from the image forming mode to the cleaning mode to carry out cleaning process of the fur brush roller 51. Here, the controlling part 2 executing the fur brush roller cleaning process corresponds to the deciding part, the rotation controlling part and mode changing part according to the present disclosure.

In step S21, the controlling part 2 decides whether or not the image forming indication of the image forming apparatus 10 is inputted. Concretely, the controlling part 2 decides whether or not indication, such as copy or print, from the user is inputted. The controlling part 2 waits until the image forming indication is inputted (step S21: NO). By contrast, the image forming indication is inputted to the controlling part 2, the process is shifted to step S22 (step S21: YES).

In step S22, the controlling part 2 prepares, in the image forming apparatus 10 in the image forming mode, to form the image based on the inputted image data onto the sheet S. At that time, the controlling part 2 sets the driving motor 58 rotating the fur brush roller 51 to the rotational speed Va. Moreover, the controlling part 2 applies the first bias to the first charging part 55. Thereby, the controlling part 2 controls so that the toner remained on the intermediate transferring belt 5 after transferring the toner image can be collected by the belt cleaning device 50. After that, the process is shifted to step S23.

In step S23, the controlling part 2 controls so as to form the image for one page based on the image data onto the sheet S. Meanwhile, since the intermediate transferring belt 5 and the fur brush roller 51 are rotated, the toner is collected and held by the belt cleaning device 50. Therefore, the toner accumulated quantity held by the fur brush roller 51 is increased. After that, the process is shifted to step S24. In step S24, the controlling part 2 decides whether or not indicated image forming is completed. Concretely, the controlling part 2 decides whether or not the number of sheets S after image forming reaches the number of sheets on the basis of the image forming indication. If it is decided that the number of sheets S after image forming does not reach the number of sheets on the basis of the image forming indication (step S24: No), the controlling part 2 shifts the process to step S25. By contrast, if it is decided that the number of sheets S after image forming reaches the number of sheets on the basis of the image forming indication (step S24: YES), the controlling part 2 shifts the process to step S26. In step S25, the controlling part 2 carries out increment of the sheet counter counting the number of sheets for image forming and shifts the process to step S23. Thus, the controlling part 2 maintains the image forming mode and forms the image onto the sheet S until the number of sheets S reaches the number of sheets on the basis of the image forming indication.

In step S26, the controlling part 2 decides whether or not a value of the sheet counter is equal to or more than a threshold number determined in advance. If it is decided that the value of the sheet counter is less than the threshold number (step S26: NO), the controlling part 2 finishes the process with keeping the image forming mode. In such a case, the controlling part 2 stops the driving motor 58 rotating the fur brush roller 51 at the rotational speed Va. On the other hand, if it is decided that the value of the sheet counter is equal to or more than the threshold number (step S26: YES), the controlling part 2 shifts the process to step S27. In such a case, the controlling part 2 changes from the image forming mode to the cleaning mode in the image forming apparatus 10.

In step S27, the controlling part 2 controls so that the first charging part 55, the charging device 12 and the third charging part 61 are applied by potentials in the cleaning mode. In such a case, to the fur brush roller 51, the first bias is applied by the first charging part 55. To the photosensitive drum 11, the second bias is applied by the charging device 12. To the toner at the upstream side from the belt cleaning device 50 in the traveling (rotating) direction on the intermediate transferring belt 5, the third bias is applied. Thereby, the controlling part 2 controls so that the toner on the intermediate transferring belt 5 is easily collected by the belt cleaning device 50. Moreover, the controlling part 2 controls so that the toner electrically charged to the reversed polarity and non-collected by the belt cleaning device 50 can be moved to the photosensitive drum 11 at the downstream side. After that, the process is shifted to step S28.

Figure 10A:
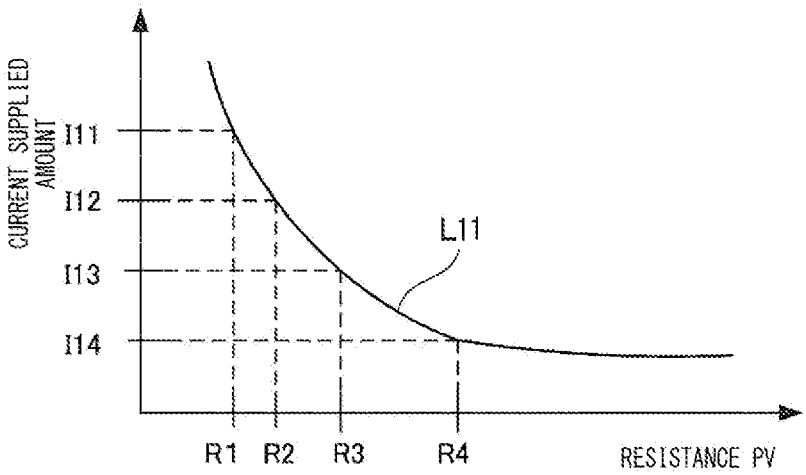
FIGS. 10A-10C are graphs showing relationships corresponding to a wear amount of the fur brush roller.

In step S28, the controlling part 2 decides the wear amount of the brush bristles 51B of the fur brush roller 51 due to contact. For example, the controlling part 2 maintains voltage applied by the first charging part 55 constant and obtains the current value flowed from the first charging part 55 to the collecting roller 52 by the current detecting part 56, in a case where the first charging part 55 applies the first bias to the fur brush roller 51. In the ROM of the controlling part 2, a corresponding table to a first current value indicating relationship between the current value flowed in the collecting roller 52 and variation of a resistant value PV caused by wear of the brush bristles 51B of the fur brush roller 51 is stored. As indicated by a solid line L11 in FIG. 10A, in the corresponding table to the first current value, if the resistant value PV is increased in order of R1, R2, R3, and R4, the current value is decreased in order of I11, I12, I13, and I14. The controlling part 2 decides the wear amount of the brush bristles 51B on the basis of the corresponding table to the first current value stored in the ROM and the current value obtained by the current detecting part 56B. After that, the process is shifted to step S29. Incidentally, the controlling part 2 executing step S28 corresponds to the deciding part of the present disclosure.

In step S29, the controlling part 2 sets the rotational speed of the fur brush roller 51 to the rotational speed Vb, in accordance with the wear amount of the brush bristles 51B decided in step S28. In such a case, the controlling part 2 sets the rotational speed Vb to the rotational speed determined in inverse proportion to the wear amount of the brush bristles 51B. The rotational speed Vb is changed according to the wear amount slow. Thereby, it is possible to prevent the intermediate transferring belt 5 from being damaged by the worn brush bristles 51B. After that, the process is shifted to step S30.

In step S30, the controlling part 2 sets the cleaning time while the fur brush roller 51 is rotated at the rotational speed Vb, in accordance with the wear amount of the brush bristles 51B decided in step S28. In such a case, the controlling part 2 sets the cleaning time in proportion to the wear amount of the brush bristles 51B. Thereby, even if the rotational speed Vb of the fur brush roller 51 is lowered, it is possible to maintain the toner accumulated quantity of the toner held by the fur brush roller 51 to the threshold quantity THR or less and to improve the toner collecting capacity. After that, the process is shifted to step S31.

In step S31, the controlling part 2 decides whether or not a driving time while the driving motor 58 rotates the fur brush roller 51 at the rotational speed Vb reaches the cleaning time. The controlling part 2 waits until the cleaning time is elapsed (step S31: NO). By contrast, if it is decided that the cleaning time is elapsed (step S31: YES), the controlling part 2 stops driving of the driving motor 58 and shifts the process to step S32. Incidentally, the controlling part 2 executing steps S29-S31 corresponds to the rotation controlling part of the present disclosure.

In step S32, the controlling part 2 changes the value of the threshold number in accordance with the wear amount of the brush bristles 51B, clears the value of the sheet counter and finishes the process. The threshold number is the number of sheets when the image forming apparatus 10 forms the image onto the sheet S in the image forming mode and is corresponding to a period while the image forming apparatus 10 executes the image forming mode. As the threshold number is changed to smaller value, the period of the image forming mode is shorter. As the threshold number is changed to larger value, the period of the image forming mode is longer. A threshold corresponding table getting the small value corresponding to the wear amount of the brush bristles 51B is stored in the ROM of the controlling part 2 in advance. On the basis of the threshold corresponding table, the threshold number is changed, in accordance with the wear amount of the brush bristles 51B decided in step S28. Thereby, the controlling part 2 can change the timing switching from the image forming mode to the cleaning mode in proportion to the wear amount of the brush bristles 51B. Moreover, the controlling part 2 changes the image forming apparatus 10 from the image forming mode to the cleaning mode by clearing the value of the sheet counter. Incidentally, the controlling part 2 executing steps S26 and S32 corresponds to the mode changing part of the present disclosure.

As described above, according to the image forming apparatus 10 of the present procedure, by controlling the rotational speed of the fur brush roller 51 in accordance with a wear state of the fur brush roller 51, it is possible to restrain the wear of the fur brush roller 51 and to remove the toner remained on the intermediate transferring belt 5. Moreover, by lengthening the cleaning time in the cleaning time when cleaning the fur brush roller 51 in accordance with the wear state of the fur brush roller 51 and bringing forward the timing from the image forming mode to the cleaning mode, it is possible to remove the toner in a long period even if using the worn fur brush roller 51.

Next, a modified example of the second embodiment will be described. In the description of the second embodiment, although a case where the brush bristles 51B is worn and shortened as the wear of the fur brush roller 51 is described, the present disclosure is not restricted by this. A case where a force scraping the toner when the brush bristles 51B comes into contact with the intermediate transferring belt 5 is weakened due to aged deterioration of the brush bristles 51B is also contained. Moreover, a case where an electrical charging property of the brush bristles 51B is deteriorated, a potential difference to the remained toner is increased and a capacity collecting toner is weakened due to aged deterioration of the brush bristles 51B is also contained.

In the description of the second embodiment, although a case where the charging controlling part 44 applies voltage to the first charging part 55, the charging device 12 and the third charging part 61 is described, the present disclosure is not restricted by this. As long as the charging controlling part 44 applies voltage to the fur brush roller 51 in the cleaning mode, it may be simply configured without applying voltage to the charging device 12 and the third charging part 61.

In the description of the second embodiment, although a case where the controlling part 2 controls the rotational speed of the driving motor 58 rotating the fur brush roller 51 in the cleaning mode, the present disclosure is not restricted by this. The controlling part 2 may changes the rotational speed Va of the driving motor 58 rotating the fur brush roller 51 in the image forming mode, in accordance with the wear amount of the brush bristles 51B. Thereby, the controlling part 2 can prevent the intermediate transferring belt 5 in the image forming mode from being damaged by the worn fur brush roller 51. In that case, a capacity collecting toner may be weakened due to contact of the fur brush roller 51 with the intermediate transferring belt 5. In such a case, the controlling part 2 may increase the first bias of the first charging part 55.

In the description of the second embodiment, although a case where the ROM of the controlling part 2 stores the corresponding table of the wear amount and the current value, the present disclosure is not restricted by this. For example, in the ROM, a calculation formula calculating the wear amount of the brush bristles 51B from the current value obtained from the current detecting part 56B or a calculation formula calculating the value of the first bias and the current amount applied by the first charging part 55 may be stored.

Figure 10B:
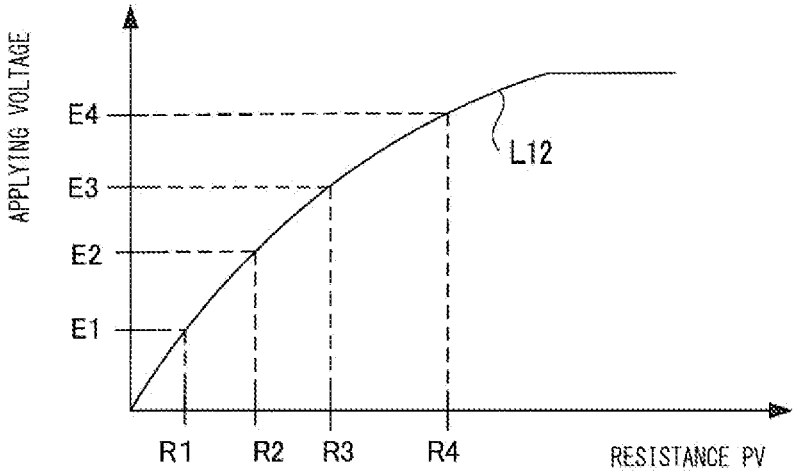

In the description of the second embodiment, although a case where the current detecting part 56B is arranged in order to detect the wear amount of the fur brush roller 51, the present disclosure is not restricted by this. As long as another value varying in accordance with the wear amount of the fur brush roller 51 can be detected and the controlling part 2 can decide the wear amount of the detected result, another configuration may be applied. For example, the image forming apparatus 10 may include a voltage detecting part 57 detecting a voltage value of the first bias applied from the first charging part 55 to the collecting roller 52. The voltage detecting part 57 is connected to the controlling part 2 and a detected value (the voltage value) detected by the voltage detecting part 57 is outputted to the controlling part 2. An electrical property of the fur brush roller 51 is varied so that the electric resistance is increased according to the wear amount of the brush bristles 51B. Therefore, if the current amount is maintained constant and the first charging part 55 applies the first bias to the fur brush roller 51, the voltage value applied to the collecting roller 52 by the first charging part 55 is heightened. Thereupon, in the ROM of the controlling part 2, as indicated by a solid line L12 in FIG. 10B, a corresponding table to the voltage value indicating relationship between the voltage value of applied voltage applied to the collecting roller 52 and variation of a resistance value PV caused by wear of the brush bristles 51B of the fur brush roller 51 is stored in advance. In the corresponding table to the voltage value, if the resistant value PV is increased in order of R1, R2, R3, and R4, the applied voltage is increased in order of E1, E2, E3, and E4. The controlling part 2 decides the wear amount of the brush bristles 51B on the basis of the corresponding table to the voltage value stored in the ROM and the voltage value obtained by the voltage detecting part 57.

The controlling part 2 may decide the wear amount on the basis of both the voltage detecting part 57 and the current detecting part 56B. In other words, the controlling part 2 may decide the wear amount of the brush bristles 51B on the basis of any one or both of variation of the voltage value applied by the first charging part 55 and variation of the current value flowed from the first charging part 55 to the fur brush roller 51. Further, the current detecting part 56B outputs the voltage value, which is applied to the collecting roller 52 by the first charging part 55, to the controlling part 2. The voltage detecting part 57 outputs the current value of the current, which is flowed from the first charging part 55 to the fur brush roller 51, to the controlling part 2. The controlling part 2 may decides the wear amount of the brush bristles 51B on the basis of any one or both of variation of the voltage value and the current value.

Figure 10C:
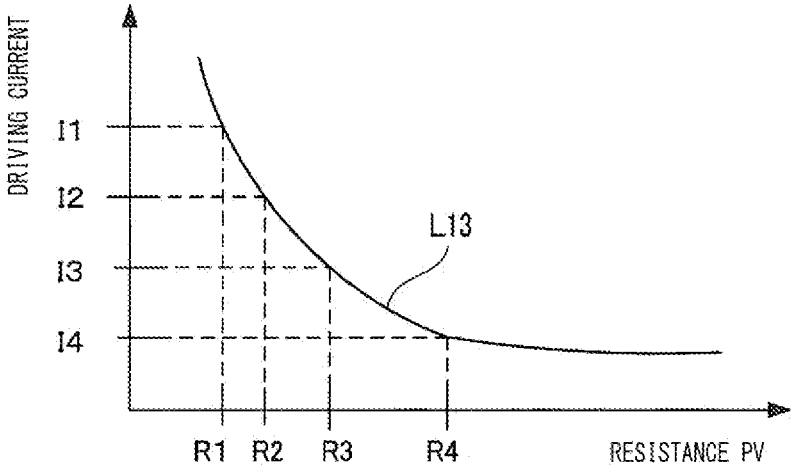

For example, the image forming apparatus 10 includes a current detecting part 56A detecting a current amount of a driving current flowing to the driving motor 58. If the brush bristles 51B of the fur brush roller 51 are worn, the contact area between the fur brush roller and the intermediate transferring belt 5 is narrowed. Thereby, a load of the driving motor 58 rotating the fur brush roller 51 is reduced. Therefore, in a case rotating the fur brush roller 51 at the same speed, the current amount of the driving current flowing to the driving motor 58 is decreased. Thereupon, in the ROM of the controlling part 2, as indicated by a solid line L13 in FIG. 10C, a corresponding table to the second current value indicating relationship between the current amount of the driving current driving the driving motor 58 and variation of a resistance value PV caused by wear of the brush bristles 51B of the fur brush roller 51 is stored. In the corresponding table to the second current value, if the resistant value PV is increased in order of R1, R2, R3, and R4, the driving current is decreased in order of I1, I2, I3, and I4. The controlling part 2 decides the wear amount of the brush bristles 51B on the basis of the corresponding table to the second current value stored in the ROM and the current amount obtained by the current detecting part 56A.

In the description of the second embodiment, although a case where the controlling part 2 changes the value of the threshold number to change the timing switching from the image forming mode to the cleaning mode, the present disclosure is not restricted by this. The controlling part 2 may carry out addition of the sheet counter by weighting according to the wear amount of the brush bristles 51B instead of increment matching the sheet counter to the number of prints in the image forming mode. For example, in a case where 9 sheets are printed, the controlling part 2 may change the value of the sheet counter to 10 by automatically adding 1 to the sheet counter.

In the description of the first embodiment and the second embodiment, although a case where an example of the image carrier is the intermediate transferring belt 5, an example of the transferred medium is a sheet S and an example of the cleaning member is the fur brush roller 51 arranged in the belt cleaning device 50, the present disclosure is not restricted by this. For example, the image carrier may be the photosensitive drum 11, the transferred medium may be the intermediate transferring belt 5 and the cleaning member may be a brush roller arranged in the cleaning device 17. In the second embodiment, the controlling part 2 may decide a wear amount of the brush roller and change rotational speed of the brush roller.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. An image forming apparatus comprising:

an image carrier being arranged rotatably and having a surface to carry a toner image transferred onto a transferred medium;

a cleaning member rotating and coming into contact with the surface of the image carrier at a downstream side in a rotating direction from a transferring position transferring the toner image onto the transferred medium to collect a toner from the image carrier and to hold the toner;

a deciding part deciding a wear amount of the cleaning member due to contact;

a rotation controlling part changing rotational speed of the cleaning member in accordance with the wear amount decided by the deciding part;

a developing part developing the toner image onto the image carrier by charged toner;

a first voltage applying part applying a first bias with a reversed polarity to a first charging polarity of the toner of the image carrier into the cleaning member;

a collecting roller rotating and coming into contact with the cleaning member and having a surface on which the toner held from the image carrier by the cleaning member is adhered;

a scraping member coming into contact with the surface of the collecting member and scraping the adhered toner; and a photosensitive drum onto which the toner image to be transferred onto the image carrier is formed, wherein the image carrier is an intermediate transferring belt extended by a driving roller and a following roller, is subjected to first-transferring of the toner image from the photosensitive drum and second-transfers the toner image onto the transferred medium, the cleaning member is a brush roller having a plurality of brush bristles projected from an outer circumference of a rotating shaft to an outward side in a radial direction and their top portions are deformed by contact with the intermediate transferring belt, the first voltage applying part applies the first bias to the brush roller via the collecting roller, the deciding part decides the wear amount on the basis of any one or both of variation of the voltage value of the first bias applied into the collecting roller by the first voltage applying part and variation of a current value of current flowed from the first voltage applying part to the collecting roller.

2. The image forming apparatus according to claim 1, wherein the rotation controlling part executes any mode of an image forming mode and a cleaning mode, the image forming mode rotating the cleaning member at first rotational speed in a time of image forming in which the toner image is transferred from the image carrier to the transferred medium, the cleaning mode rotating the cleaning member at second rotational speed faster than the first rotational speed in a time of cleaning except for the time of image forming and removing the toner held by the cleaning member, the second rotational speed is speed determined in inverse proportion to the wear amount.

3. The image forming apparatus according to claim 2, wherein the rotation controlling part changes the rotational speed of the cleaning member in accordance with the wear amount and changes a cleaning time while rotating the cleaning member at the second rotational speed in proportion to the wear amount.

4. The image forming apparatus according to claim 2 further comprising:

a mode changing part changing timing switching from the image forming mode to the cleaning mode by the rotation controlling part in proportion to the wear amount.

5. The image forming apparatus according to claim 1 further comprising:

a driving motor rotating the cleaning member, wherein the deciding part decides the wear amount on the basis of variation of current value of driving current flowed to the driving motor.

6. The image forming apparatus according to claim 1 further comprising:

a second voltage applying part applies a second bias with a reversed polarity to the first bias into the photosensitive drum at a downstream side from the brush roller in the rotating direction of the intermediate transferring belt when the rotation controlling part executes the cleaning mode so that the toner charged to a second charging polarity reversed to the first charging polarity is moved from the intermediate transferring belt to the photosensitive drum; and a collecting part collecting the toner adhered on the surface of the photosensitive drum.

7. The image forming apparatus according to claim 1 further comprising:

a third voltage applying part being arranged at an upstream side from the brush roller in the rotating direction of the intermediate transferring belt and applying a third bias with a reversed polarity to the first bias when the rotation controlling part executes the cleaning mode so that the toner of the intermediate transferring belt is charged to the first charging polarity.

* * * * *